US005984764A

United States Patent [19]

Saito et al.

[11] Patent Number: 5,984,764

[45] Date of Patent: Nov. 16, 1999

[54] METHOD OF DRESSING AN ABRASIVE CLOTH AND APPARATUS THEREFOR

[75] Inventors: Hideo Saito, Numazu; Hiromi Nishihara; Fumitaka Ito, both of Fuji; Hironobu Hirata, Mishima, all of Japan

[73] Assignee: Toshiba Kikai Kabushiki Kaisha, Tokyo-to, Japan

[21] Appl. No.: 08/861,200

[22] Filed: May 21, 1997

[30] Foreign Application Priority Data

May 21, 1996 [JP] Japan ..... 8-125984
Jun. 11, 1996 [JP] Japan ..... 8-149240

[51] Int. Cl.[6] ..... B24B 1/00

[52] U.S. Cl. ..... 451/56; 451/63; 451/41

[58] Field of Search ..... 451/11, 56, 57, 451/63, 67, 72, 443, 444, 41, 285, 287

[56] References Cited

U.S. PATENT DOCUMENTS 5,384,986 1/1995 Hirose et al. ..... 451/444
5,421,768 6/1995 Fujiwara et al. ..... 451/283
5,456,627 10/1995 Jackson et al. ..... 451/11
5,486,131 1/1996 Cesna et al. ..... 451/56
5,531,635 7/1996 Mogi et al. ..... 451/56
5,547,417 8/1996 Breivogel et al. ..... 451/56
5,674,109 10/1997 Kanzawa et al. ..... 451/41
5,676,590 10/1997 Hiraoka ..... 451/287

*Primary Examiner*—David A. Scherbel
*Assistant Examiner*—Derris Holt Banks
*Attorney, Agent, or Firm*—Pillsbury Madison & Sutro LLP

[57] ABSTRACT

The present invention relates to a method of discovering optimal conditions such as the rotational speed ratio of an abrasive cloth and a dresser, to improve the flatness of the abrasive cloth after it has been dressed. A narrow annular dresser having an inner diameter of at least the width of a wide annular utilization region of the abrasive cloth is pressed while rotating against the abrasive cloth which is fixed onto a turn table. A rotational motion is imparted to the abrasive cloth in the same direction as the rotation of the dresser and at a predetermined rotational speed. The abrasive cloth is dressed thereby in such a manner that there is a uniform distribution of distances through which the grindstone slides over various points within the utilization region of the abrasive cloth.

11 Claims, 19 Drawing Sheets

FIG. 20(a)
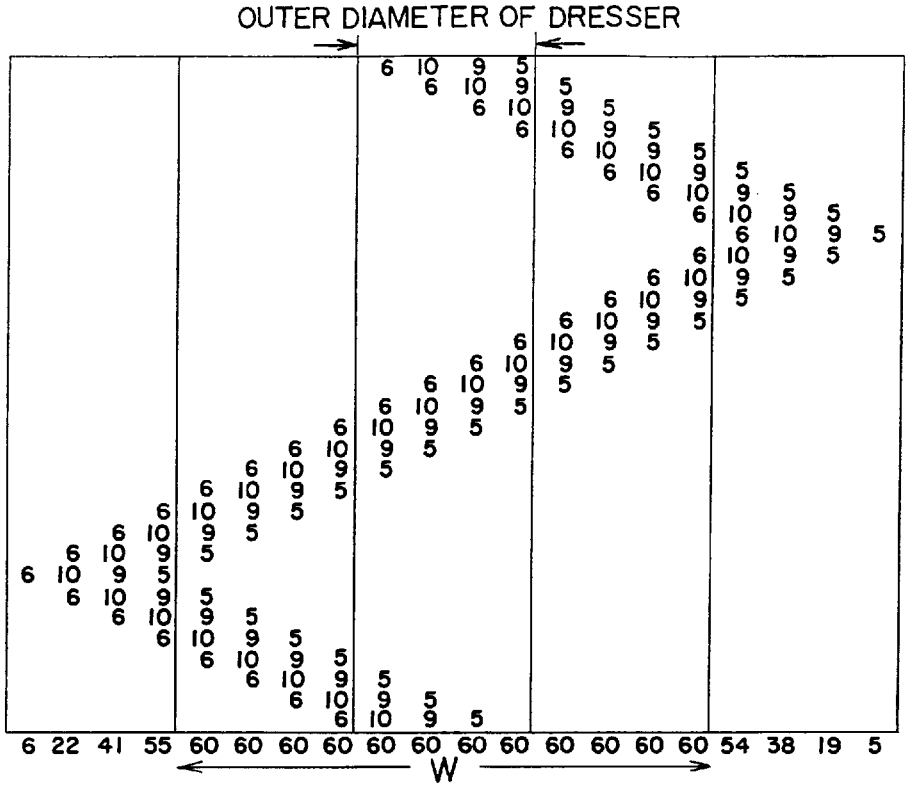
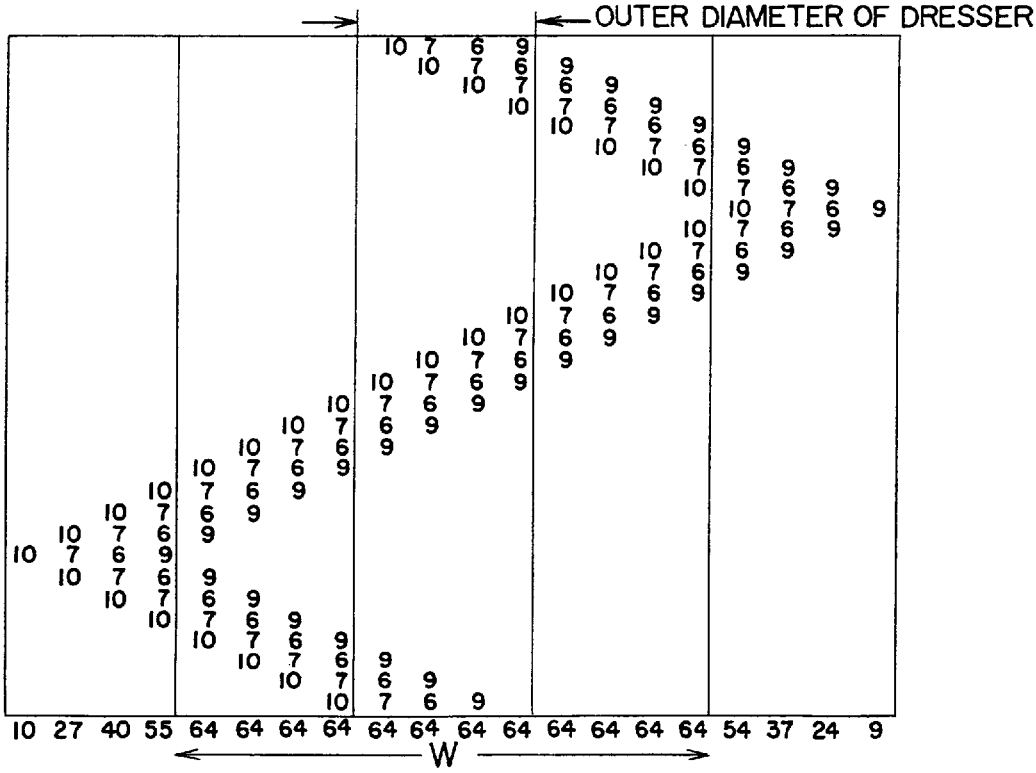
FIG. 20(b)

FIG. 22(a)
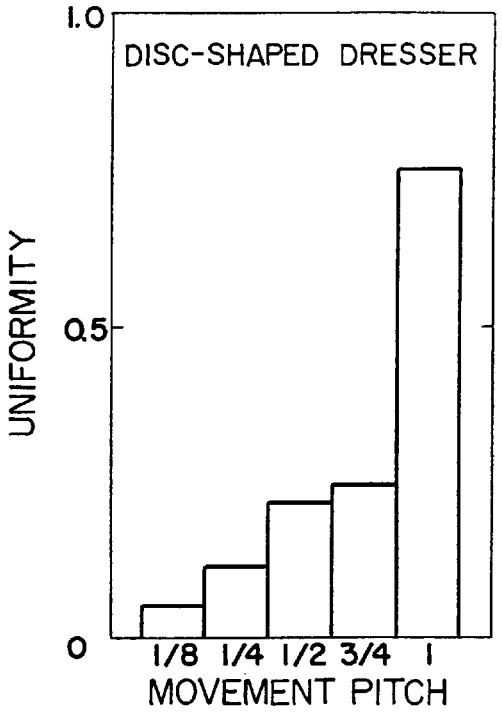
FIG. 22(b)
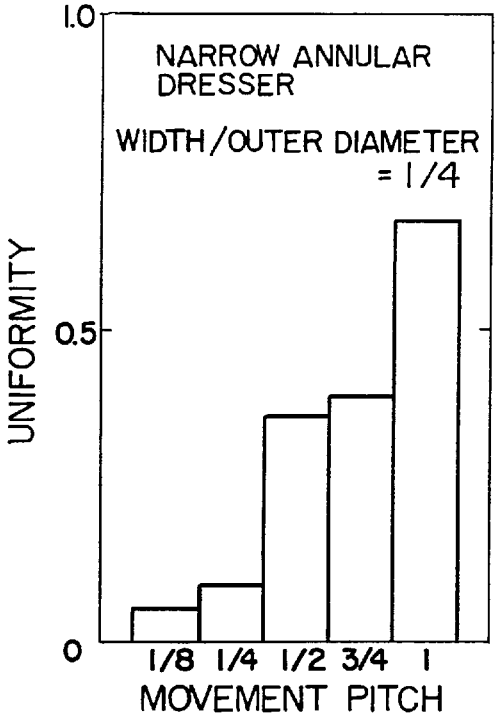
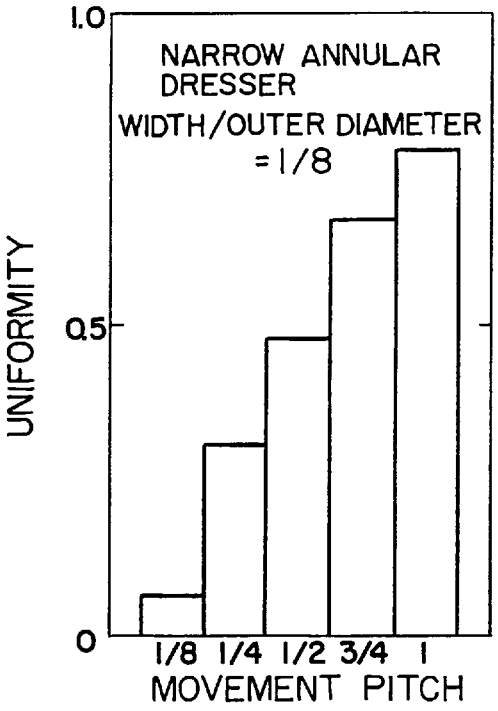
FIG. 22(c)
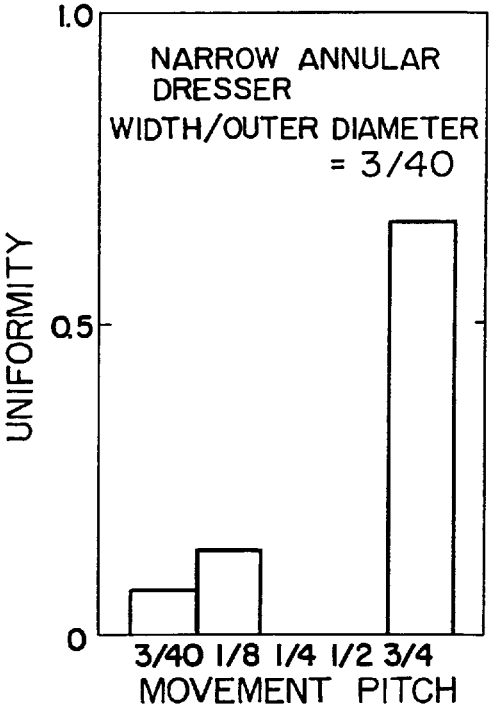
FIG. 22(d)

METHOD OF DRESSING AN ABRASIVE CLOTH AND APPARATUS THEREFOR

BACKGROUND OF THE INVENTION

The present invention relates to a method of dressing an abrasive cloth used in the polishing of a flat surface, and an apparatus therefor. In particular, it relates to a method of dressing an abrasive cloth by using a disc-shaped or narrow annular dresser, and an apparatus therefor.

A demand has recently arisen for a particularly high level of accuracy in the polishing of a flat surface, in fields such as the polishing of semiconductor wafers. When a flat surface is created on a workpiece by a polishing device that is used for such extremely accurate polishing, it is necessary that the flatness of a surface plate that is orientated parallel to the work surface of the workpiece should be extremely high, in order to increase the accuracy of the flat surface of the workpiece.

With this type of polishing, the surface plate itself is subjected to the polishing action of an abrasive material, so that the flatness of the surface plate gradually deteriorates. To maintain this flatness of the surface plate, it is therefore necessary to recondition it by using a suitable grindstone.

While the importance of correcting the flatness of a surface plate has long been recognized, the reconditioning of such surface plates is currently performed by empirical methods. For example, to counteract any deterioration in shape of a surface plate used in lapping, which is one type of polishing, a corrective ring into which the workpiece is inserted is placed on the surface plate. The state of wear of the surface plate causes the corrective ring to move as appropriate in the radial direction of the surface plate, thus correcting the flatness of the surface plate while the lapping is being performed (refer to pages 89–90 of Precision Finishing and Special Processing, published by Meigensha in 1987).

There are many different types of polishing machines. One type polishes a workpiece against an abrasive cloth that is spread over the surface plate. The term, an abrasive cloth in the specification and claims includes a polishing pad used in the field of polishing process for semiconductor wafers. This abrasive cloth is made of an elastomer, a soft plastic, a woven material with fibers arranged in a regulated manner, or a nonwoven fabrics. With this type of polishing machine, the abrasive cloth must be dressed in a suitable manner. An abrasive cloth that has been dressed unevenly will reduce the accuracy of the flat surface of the workpiece. However, the conditions for dressing this type of abrasive cloth are still being discovered by repeated trial and error, so that there is currently no established technique therefor.

SUMMARY OF THE INVENTION

An objective of the present invention is therefore to solve the above problem with the prior art. It provides a method and apparatus for dressing an abrasive cloth which determines optimal conditions, such as the ratio of the rotational speeds of the abrasive cloth and the dresser and the speed of movement of the dresser, and which is capable of causing an improvement in the flatness of the abrasive cloth after the dressing.

The dressing method in accordance with the present invention is based on the assumption that the mechanism of a process that dresses an abrasive cloth is basically different from that of a process of grinding a metal or hard, brittle material, even when the same dresser is used. With a process of grinding a metal or hard, brittle material, the amount of processing and the processing form are determined by the depth of cut of the grindstone. However, an abrasive cloth is soft and is forcibly deformed when a grindstone is pressed against it, so that the depth of cut of the grindstone does not correspond to the amount of polishing.

It is thought that the inevitability of determining processing conditions for the dressing of an abrasive cloth empirically by trial and error was based on this characteristic of the abrasive cloth.

The method of an abrasive cloth dressing according to the invention has a viewpoint that is basically different from that of conventional dressing processes in that it assumes that the processing characteristics thereof are more similar to those of polishing than grinding, to determine optimal processing conditions.

With polishing processes in general, the factors that exhibit a strong correlation with the resultant removal are the pressure with which the workpiece is pressed against the polishing surface plate and the distance through which a dresser slides over the surface of the abrasive cloth. In practice, there is not normally a linear relationship between the pressure or sliding distance and the removal, because of fracturing or deterioration of the polishing material. However, since the processing action is applied by a dresser that tends not to fracture or deteriorate, instead of a polishing material, during the dressing of an abrasive cloth by a dresser in accordance with this invention, a substantially proportional relationship can be predicted between the pressure and the removal, and also between the sliding distance and the removal. Since it can also be assumed that the dresser of the present invention is pressed against the abrasive cloth with constant pressure, the form of the abrasive cloth after the dressing is considered to be mainly determined by the distribution of sliding distances of the dresser at different points of the abrasive cloth.

A method of dressing an abrasive cloth is illustrated in FIG. 4, wherein a rotational motion is imparted to a narrow annular dresser 2 while a rotational motion is also imparted in the same direction to an abrasive cloth 1 upon a turn table. The abrasive cloth 1, which is attached to the rotates at a rotational speed N1 about a center O1 of rotation. Similarly, the dresser 2 is rotated at a rotational speed N2 in the same direction about a center O2 of rotation.

The abrasive cloth 1 has a radius R and a concentric region thereof of width W, which is shown hatched in FIG. 4, is the portion that is actually utilized for the polishing. The present invention causes this utilization region to be dressed. The distance from the center O1 of the abrasive cloth 1 to a central position of the utilization region is denoted by A. If Do is the outer diameter of the dresser and Di is the inner diameter thereof, the following relationships hold when the utilization region of the abrasive cloth 1 is reconditioned by a dresser of such dimensions:

$$W \leqq Di < Do \leqq R \text{ and } A \geqq Do/2$$

Examples of the distribution of distances through which the dresser slides over various points of the abrasive cloth 1, which were obtained by computer simulations, are shown in FIG. 5.

The results of simulations of the sliding distance distribution shown in this graph are cross-sections taken in four directions at 0°, +90°, +180°, and −90° about the center of rotation O1, during one cycle from the start of dressing until the abrasive cloth 1 and the dresser 2 returned to the same positional relationship, when the processing conditions were such that the rotational speeds of the abrasive cloth 1 and the dresser 2 were the same. In this case, the same sliding distance distribution was seen in all directions about the center of rotation of the abrasive cloth, as shown by the above four representative directions, if the dressing time was an integral multiple of the cycle of changes in the positional relationship between the abrasive cloth 1 and the dresser 2.

The form of the abrasive cloth 1 after the dressing can be predicted from this sliding distance distribution.

This is shown in FIG. 6. This graph is based on the assumption that the maximum sliding distance is 1, locations in the radial direction through the utilization region of the abrasive cloth are plotted along the horizontal axis, and the ratio of sliding distance to maximum sliding distance at each of these locations is plotted along the vertical axis. The results of dressing an abrasive cloth by using a real polishing machine under the same conditions verified that the form of the actual abrasive cloth after the dressing conformed closely with the form and characteristics of the graph of FIG. 6. These experiments made it clear that obtaining a sliding distance distribution is effective in pre-evaluating the dressing form.

The method of dressing an abrasive cloth in accordance with this invention makes it possible to provide an abrasive cloth that is optimal for precision polishing, by achieving conditions that optimize the uniformity and symmetry of the sliding distance distribution, based on the above findings, thus causing an improvement in the flatness of the abrasive cloth after the dressing.

The dressing method of this invention is characterized in the use of a narrow annular dresser having an inner diameter that is at least the width of a wide annular utilization region of the abrasive cloth, where this dresser is pressed against the abrasive cloth while the cloth is being rotated. The dressing is performed in such a manner that the sliding distance distribution of the dresser is uniform over all portions in the radial direction within the utilization region of the abrasive cloth, while a rotational motion at a predetermined rotational speed in the same direction as the rotation of the dresser is imparted to the abrasive cloth which is fixed to a turn table.

In a preferred embodiment of the abrasive cloth dressing method of this invention, the dressing of the abrasive cloth is performed with the ratio of the rotational speed of the abrasive cloth to the rotational speed of the dresser set to be within the range of 1.5 to 4.0. The sliding distance distribution of the dresser can be made uniform by setting the ratio of the inner diameter of the dresser to the width of the utilization region of the abrasive cloth, or the ratio of the outer diameter to the inner diameter of the dresser, to be large.

If limitations are imposed on the size of the abrasive cloth or the apparatus itself, the flatness of the dressing state of the abrasive cloth can be improved by ensuring that the dressing of the abrasive cloth is performed by using a dresser wherein the outer diameter of the dresser is between 1.5 and 1.8 times the width of the utilization region of the abrasive cloth, without leading to any deterioration in the utilization ratio of the abrasive cloth.

It is further preferable that the distance from the center of the abrasive cloth to a central position of the wide annular utilization region of the abrasive cloth is set to be between a value that is 0.5 times the outer diameter of the dresser and a value that is 0.5 times the outer diameter of the dresser plus 0.5 times the width of the utilization region.

An apparatus for implementing the abrasive cloth dressing method of this invention is characterized in comprising a turn table to which the abrasive cloth to be dressed is attached, and which rotates at a constant rotational speed; a narrow annular dresser having an inner diameter of at least the width of a wide annular utilization region of the abrasive cloth; dresser rotation means for holding the dresser and also imparting a rotational motion at a predetermined rotational speed to the dresser; dresser movement means for causing the dresser rotation means to move and also pressing the dresser against the abrasive cloth with a predetermined pressure; and rotational speed control means for controlling the rotational speed of the abrasive cloth and the rotational speed of the dresser at preferred values.

The abrasive cloth dressing method of this invention is based on these findings. The characteristics thereof include the use of a dresser having an outer diameter that is less than the width of the wide annular utilization region of the abrasive cloth. A reciprocal motion is imparted to this dresser in the radial direction of the abrasive cloth over the utilization region, while it is pressed against the abrasive cloth which is fixed onto the turn table. The dressing of the abrasive cloth is performed in such a manner that there is a uniform distribution of sliding distances of the dresser at all locations in the radial direction within the utilization region of the abrasive cloth, while a rotational motion is being imparted to the abrasive cloth. More preferably, the amplitude of the reciprocal motion expressed by the outer diameter of the dresser should be set to within a range that is greater than or equal to the sum of the width of the utilization region of the abrasive cloth plus the outer diameter of the dresser on each of the inner and outer sides in the radial direction of the abrasive cloth, and less than or equal to the radius of the abrasive cloth.

A disc-shaped or narrow annular dresser can be used as the above dresser. If a disc-shaped dresser is used, it is preferable that the abrasive cloth is dressed by imparting a reciprocal motion to the disc-shaped dresser in such a manner that the amount of movement of the disc-shaped dresser in the radial direction of the abrasive cloth during one rotation of the abrasive cloth is ¼ or less of the outer diameter of the dresser.

If a narrow annular dresser is used, it is preferable that the abrasive cloth is dressed by imparting a reciprocal motion to the annular dresser in such a manner that the amount of movement of the annular dresser in the radial direction of the abrasive cloth during one rotation of the abrasive cloth is ¼ of the outer diameter of the dresser or the width of the edge of the dresser, whichever is the smaller.

An apparatus that implements the above abrasive cloth dressing method of the present invention comprises a turn table to which the abrasive cloth to be dressed is attached, and which rotates at a constant rotational speed; a circular dresser having an outer diameter that is less than the width of a wide annular utilization region of the abrasive cloth; dresser rotation means for holding the dresser and also imparting a rotational motion at a predetermined rotational speed to the dresser; dresser movement means for imparting to the dresser rotation means a reciprocal motion in the radial direction of the abrasive cloth, while pressing the dresser against the abrasive cloth with a predetermined pressure; and reciprocal motion control means for controlling the amount of movement and the movement speed of the reciprocal motion of the dresser.

A oscillation mechanism having a swing arm to which is attached the dresser rotation means and which oscillates in the radial direction of the abrasive cloth could be used as this dresser movement means. Alternatively, a linear movement mechanism for causing the dresser rotation means to move in a linear reciprocal manner in the radial direction of the abrasive cloth could be used therefor.

BRIEF DESCRIPTION OF THE DRAWINGS

FIG. 20 graphs numerical evaluations using the numeric models of FIG. 19, when dressing is performed by reciprocating the dresser through one cycle of a range equivalent to five times the outer diameter of the dresser;

FIGS. 22(*a*)–(*d*) show the results of analysis of simulations of the relationship between the amount of movement in the radial direction of the dresser during one rotation of the abrasive cloth and the uniformity of sliding distance distribution.

DESCRIPTION OF THE PREFERRED EMBODIMENTS

Embodiments of the present invention are described below with reference to the accompanying drawings.

Figure 1:
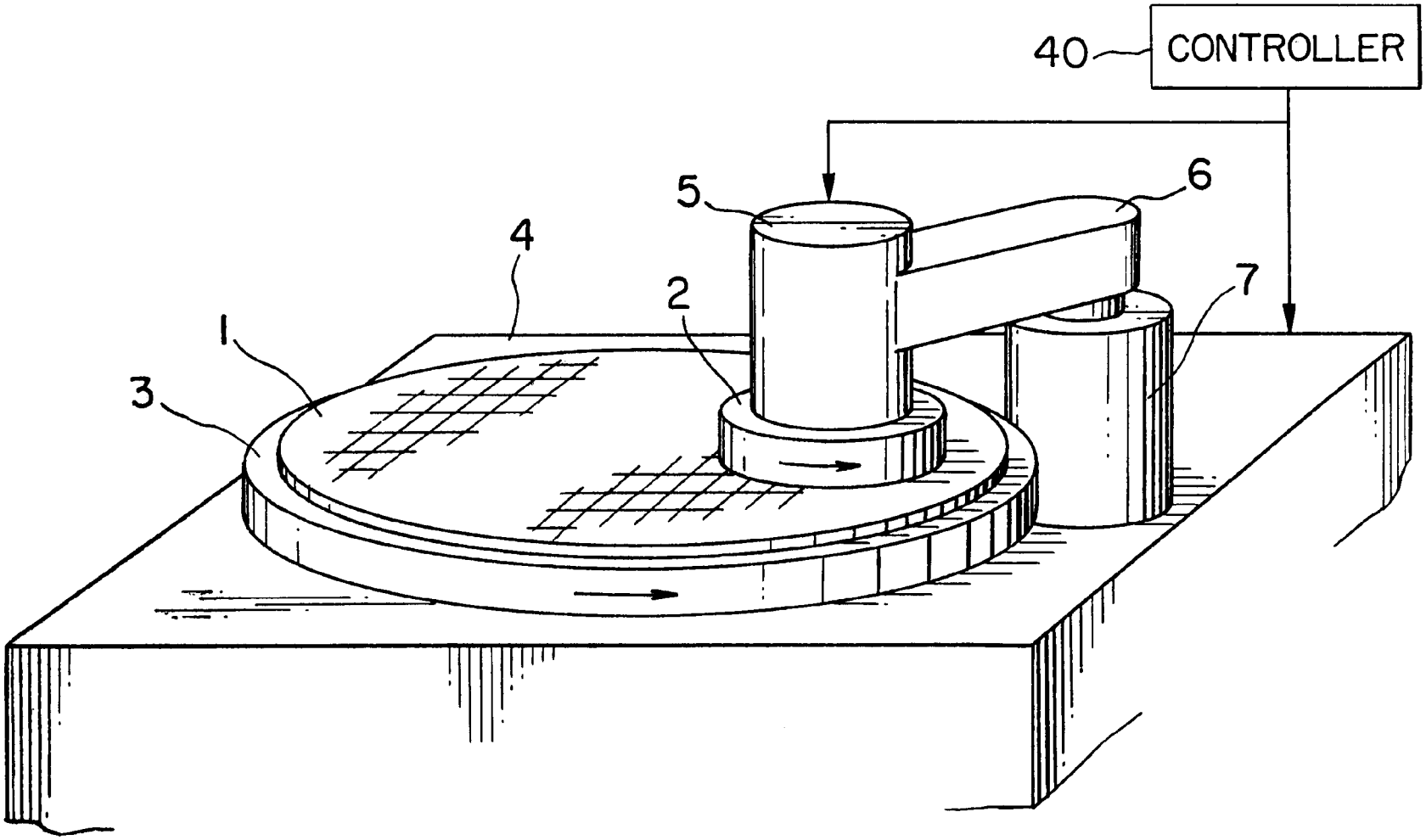
FIG. 1 is a perspective view of an embodiment of an apparatus for dressing an abrasive cloth in accordance with this invention.

An apparatus for implementing the method of dressing an abrasive cloth in accordance with this invention is shown in FIG. 1. In this figure, reference number 1 denotes an abrasive cloth and reference number 2 denotes a dresser.

The abrasive cloth 1 is made of an elastomer, a soft plastic, a woven material with fibers arranged in a regulated manner, or a nonwoven fabrics. It is attached by an adhesive or the like to a concentric position on an upper surface of a turn table 3. The turn table 3 is assembled together with a base 4 and is linked to a rotational drive mechanism (not shown in the figure).

A narrow annular grindstone is used as the dresser 2 for correcting the form of the abrasive cloth 1 when the polishing capability thereof has deteriorated. This dresser 2 is mounted on a rotational dresser head 5 configured of a rotational dresser means. The rotational speeds of the turn table 3 and the dresser 2 are each controlled as required by a controller 40.

The rotational dresser head 5 is attached to one end of an arm 6 that is capable of swivelling. The other end of this arm 6 is linked to a dresser movement mechanism 7 that incorporates a motor for swivelling. At the start of dressing of the abrasive cloth 1, the dresser movement mechanism 7 causes the arm 6 to swivel as far as a dressing position, while the rotational dresser head 5 is holding the dresser 2. This dresser movement mechanism 7 positions the dresser 2 directly above a utilization region on the abrasive cloth 1. The dresser movement mechanism 7 is also capable of causing the arm 6 to move vertically, so that the dresser 2 can be pressed against the abrasive cloth 1 with a suitable pressure.

The dresser 2 slides over the rotating abrasive cloth 1 while it is being subjected to a rotational movement from the rotational dresser head 5. This sliding motion enables the dresser 2 to dress the surface of the abrasive cloth 1.

During the dressing procedure, the rotational motions imparted to the abrasive cloth 1 and the dresser 2 are always in the same direction. When the dressing ends, the dresser movement mechanism 7 causes the arm 6 to swivel in a direction away from the turn table 3. The turn table 3 then retreats in such a manner that the dresser 2 does not come into contact with the abrasive cloth 1.

Figure 2A:
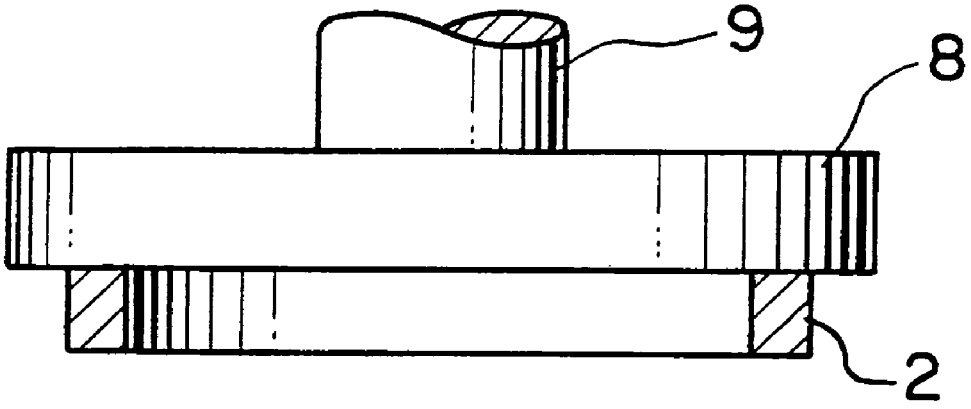
FIGS. 2(*a*) and 2(*b*) are side views of examples of dresser used for the dressing method in accordance with this invention.
Figure 2B:
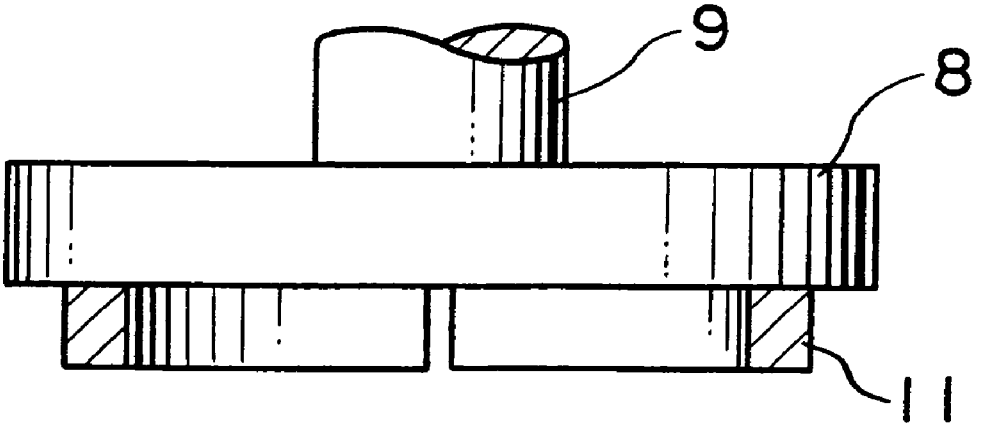
Figure 5:
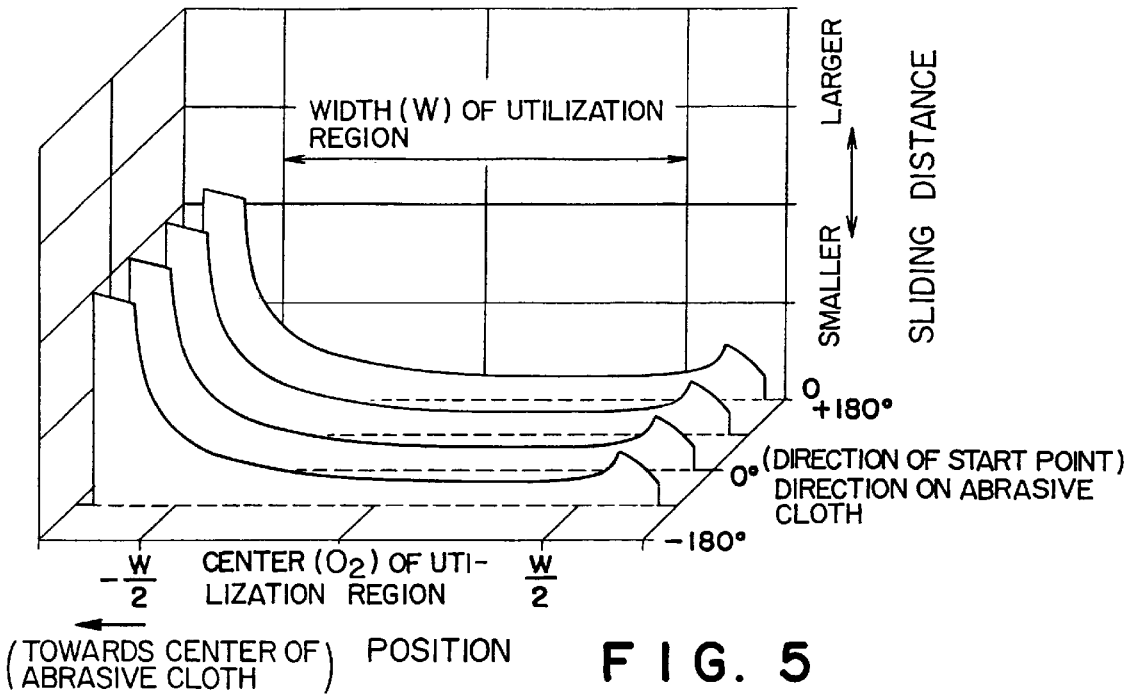
FIG. 5 is a graph of results obtained by simulating the sliding distance distribution of a dresser on an abrasive cloth.
Figure 6:
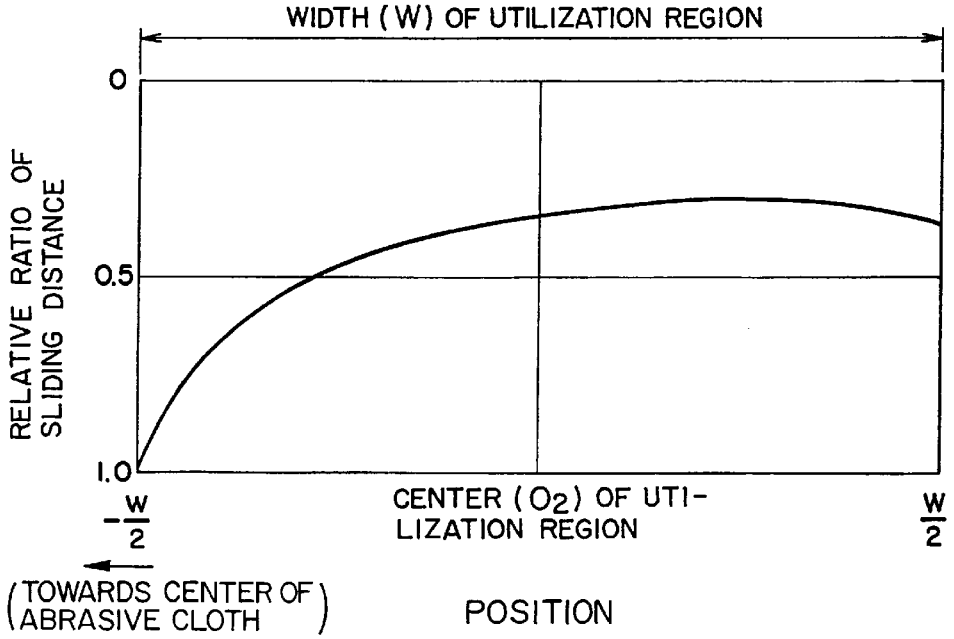
FIG. 6 is a graph predicting the form of the abrasive cloth from the sliding distance distribution.

In this first embodiment of the invention, a large-diameter dresser is used, such as is shown in FIGS. 2(*a*) and 3(*a*). This annular dresser 2 is linked to a rotational shaft 9 of the dresser movement mechanism 7 by an attachment plate 8. An inner diameter Di of the dresser 2 is larger than a width W of the utilization region of the abrasive cloth 1 (the region shown hatched in FIG. 5).

Note that a plurality of arc-shaped grindstones 11 could equally well be used as this dresser 2. These arc-shaped grindstones 11 would be arranged in such a manner that they form a narrow annular shape overall, but with a small gap 10 between adjacent grindstones 11. This arrangement of dresser makes it possible to supply a dressing liquid through the gaps 10 and also remove chippings therethrough.

A more detailed description of the present invention will now be given, using the results of computer simulations relating to the dressing process of the present invention, which is implemented by using the above dressing apparatus.

The processing conditions that affect the flatness of the dressing of the abrasive cloth are as given in Table 1:

TABLE 1

| Processing Conditions | Definition |
|---|---|
| $\kappa = N_1/N_2$ | Ratio of rotational speed of abrasive cloth to rotational speed of dresser |
| $\alpha$ = Di/W | Ratio of inner diameter of dresser to width of utilization region |
| $\beta$ = Do/Di | Ratio of outer and inner diameters of dresser |
| $\gamma$ = W/R | Ratio of width of utilization region to radius of abrasive cloth (abrasive cloth utilization ratio) |
| $\epsilon$ = (A-Do/2)/W | Deviation of central position of utilization region (ratio with respect to width of utilization region) |

A uniformity factor $\alpha$ and a symmetry factor $\lambda$ are used as characteristics for evaluation of the distribution of the distances through which the dresser slides over the abrasive cloth, based on data obtained from simulations in which the above processing conditions were changed in various ways.

Figure 7:
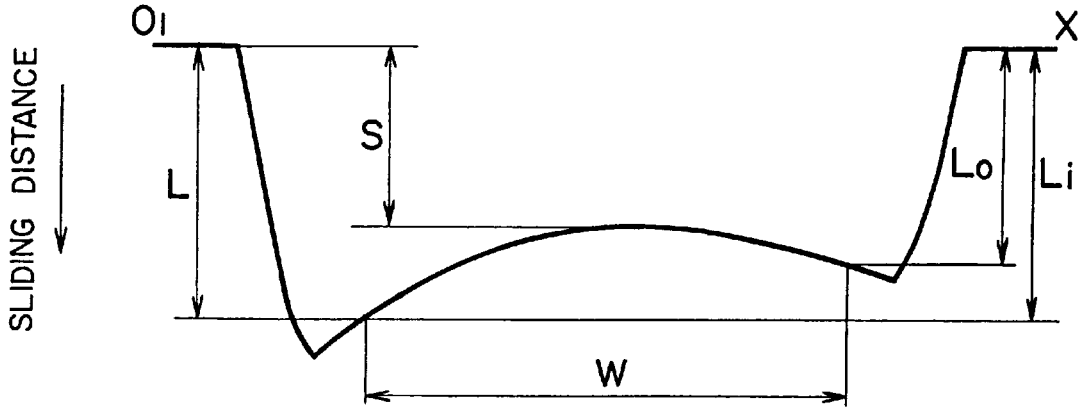
FIG. 7 shows the characteristics of a pattern of sliding distance distribution.

A distinctive pattern of sliding distance distribution that is seen in such a case is shown in FIG. 7. In this figure:

L: Maximum sliding distance

S: Minimum sliding distance

Li: Maximum sliding distance on inner side

Lo: Maximum sliding distance on outer side

Note that, if an annular dresser 2 of an inner diameter Di that is greater than the width W of the utilization region is used, either:

$$L=Li \text{ or } L=Lo$$

The uniformity factor $\delta$ is calculated from the following equation:

$$\delta=(L-S)/L \quad (1)$$

This uniformity factor $\delta$ expresses the ratio of the difference between the maximum and minimum values of the sliding distance. If it is assumed that sliding distance is substantially proportional to the resultant amount of dressing, a smaller value of the uniformity factor $\delta$ means that the distribution of sliding distances is uniform. In this case, a uniform dressing of the abrasive cloth means that the surface thereof is flat.

If an inner portion close to the center of the abrasive cloth and an outer portion close to the peripheral edge of the abrasive cloth are not dressed uniformly, within the utilization region W of the abrasive cloth, the surface of the abrasive cloth will not become a horizontal, plat surface. The symmetry factor $\lambda$, which is used as an indicator as to whether or not the distribution of sliding distance is symmetrical, is defined by the following equation:

$$\lambda=|Li-Lo|/Lo \quad (2)$$

This symmetry factor $\lambda$ is proportional to the absolute value of the difference between the sliding distance Li on the inner side of the utilization region and the sliding distance Lo on the outer side thereof. Smaller values of the uniformity factor $\delta$ and the symmetry factor $\lambda$ indicate that the result of the dressing is good.

The results of simulations of the process of dressing an abrasive cloth are as shown in FIGS. 8 to 13, in order to analyze the processing conditions quoted in Table 1.

Figure 8:
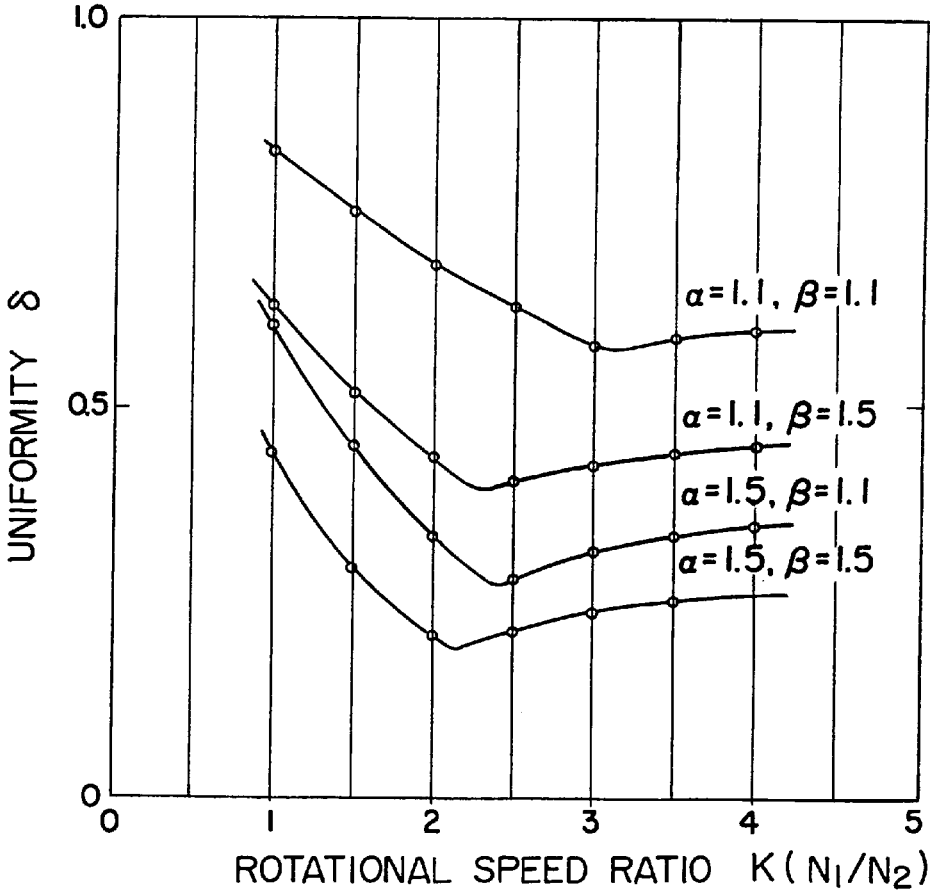
FIG. 8 graphs the results of simulations of the effect of the rotational speed ratio of the abrasive cloth and the dresser on the uniformity of the sliding distance distribution.

FIG. 8 shows the relationship between the ratio $\kappa$ of the rotational speed N1 of the abrasive cloth and the rotational speed N2 of the dresser (hereinafter called the rotational speed ratio $\kappa$) and the uniformity factor $\delta$ of the sliding distance distribution. The uniformity factor $\delta$ of the sliding distance distribution is simulated, when abrasive cloths were dressed with varying values of rotational speed ratio $\kappa$. Four different dresser were used, with differing values of a ratio $\alpha$ of the inner diameter Di of the dresser grindstone to the width W of the utilization range and a ratio $\beta$ of the outer diameter Do to the inner diameter Di of the dresser.

As can clearly be seen from FIG. 8, the uniformity factor $\delta$ initially decreases as the rotational speed ratio $\kappa$ increases (for $2>\kappa>1$). In other words, an improvement in the uniformity of the sliding distance distribution is clearly seen as the value of the rotational speed ratio $\kappa$ increases. The value of the uniformity factor $\delta$ is low within the range of rotational speed ratio $\kappa$ from 1.5 to 4.0. In particular, it reaches a minimum within the range of $2\leqq\kappa\leqq3$, regardless of the relationship between the inner-diameter/utilization-region-width ratio $\alpha$ and the outer/inner diameter ratio $\beta$, whichever type of dresser is used.

Figure 9:
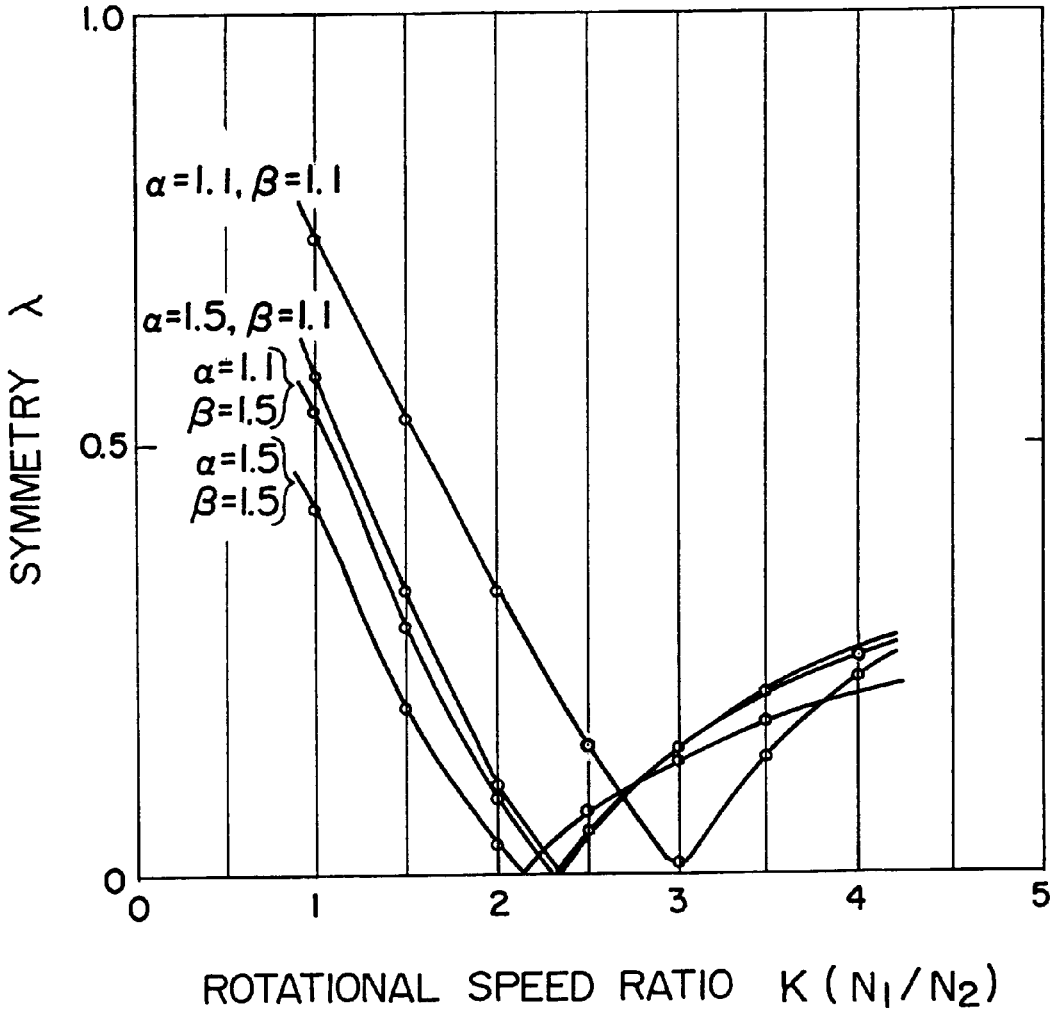
FIG. 9 graphs the results of simulations of the effect of the rotational speed ratio of the abrasive cloth and the dresser on the symmetry of the sliding distance distribution.

The results of simulations of variations in the symmetry factor $\lambda$ of the sliding distance distribution are shown in FIG. 9. The same four types of dresser as those of FIG. 8 were used, and abrasive cloths were dressed with varying values of rotational speed ratio $\kappa$. The mutual relationship between the rotational speed ratio $\kappa$ and the symmetry factor $\lambda$ is as follows. In a similar manner to that of the uniformity, the symmetry factor $\lambda$ was seen to decrease (meaning that the symmetry of the sliding distance distribution increases) within the range of rotational speed ratio $\kappa$ of 1.5 to 4.0. In particular, the symmetry of the sliding distance distribution is extremely good within the range of $2\leqq\kappa\leqq3$, regardless of the relationship between the inner-diameter/utilization-region-width ratio $\alpha$ and the outer/inner diameter ratio $\beta$, whichever type of dresser is used.

To summarize the above results: the range of rotational speed ratio $\kappa$ that enables an increase in both of the uniformity and symmetry of the sliding distance distribution is $1.5\leqq\kappa\leqq4$. A particularly preferable range of rotational speed ratio $\kappa$ is $2\leqq\kappa\leqq3$. Dressing an abrasive cloth with a rotational speed ratio $\kappa$ within this range makes it possible to dress the surface of the abrasive cloth both uniformly and flatly.

It is also clear from FIG. 9 that the symmetry factor $\lambda$ has a pattern such that it decreases to zero as the rotational speed ratio $\kappa$ increases, but then it starts to increase. It can be seen from this pattern and Equation (2) defining the symmetry factor $\lambda$ that a problem occurs. In other words, the sliding distance on the inner side is greater than the sliding distance on the outer side within the range where the rotational speed ratio $\kappa$ is small. Conversely, the sliding distance on the outer side becomes greater than the sliding distance on the inner side within the range where the rotational speed ratio $\kappa$ is large. This means that if it is found in practice that either the inner peripheral side or the outer peripheral side of the utilization region is dressed more than the other side as a result of the dressing of the abrasive cloth, careful adjustment of the rotational speed ratio $\kappa$ will make it possible to improve the symmetry of the sliding distance distribution. This enables an improvement in the biasing of dressing.

If, for example, it is found that the inner peripheral edge of the utilization region of the abrasive cloth is deeply dressed, the sliding distance on the inner side Li can be made smaller by adjusting the rotational speed of the abrasive cloth and or the dresser in such a manner that the rotational speed ratio $\kappa$ increases.

The above description concerned the effects of the rotational speed ratio $\kappa$ on the uniformity and symmetry of the sliding distance distribution. The discussion now turns to the relationships between the inner-diameter/utilization-region-width ratio $\alpha$ of the dresser, the outer/inner diameter ratio $\beta$ of the dresser, and the uniformity and symmetry of the sliding distance distribution.

It is clear from FIGS. 8 and 9 that both of the uniformity factor $\delta$ and the symmetry factor $\lambda$ of the sliding distance distribution tend to decrease as the values of $\alpha$ and $\beta$ increase. These results were obtained from simulations in which four types of dresser were combined with different values of inner-diameter/utilization-region-width ratio $\alpha$ and outer/inner diameter ratio $\beta$ of the dresser. It is therefore qualitatively clear that increases in the values of either of the inner-diameter/utilization-region-width ratio $\alpha$ and outer/inner diameter ratio $\beta$ help to increase the uniformity factor $\delta$ and the symmetry factor $\lambda$ of the sliding distance distribution.

Figure 10:
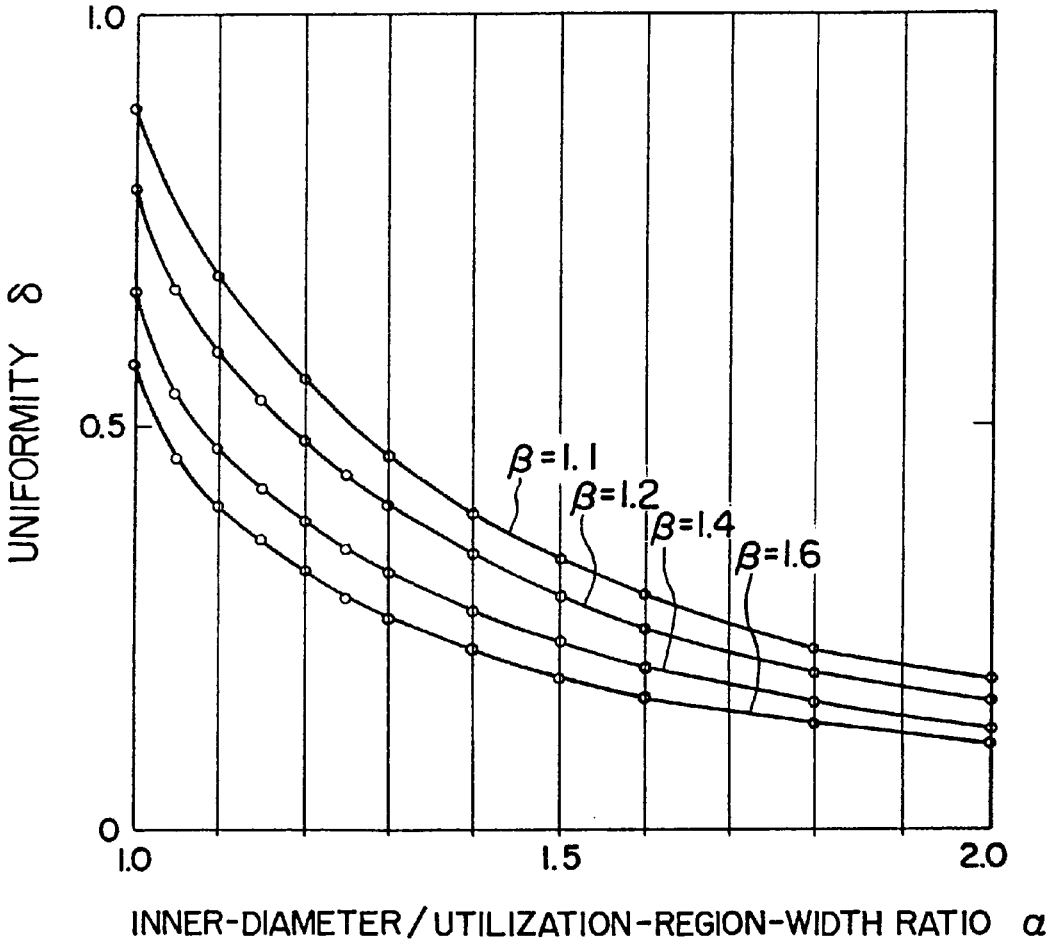
FIG. 10 graphs the results of simulations of the effect of the ratio of the inner diameter of the dresser to the width of the utilization region on the uniformity of the sliding distance distribution.
Figure 11:
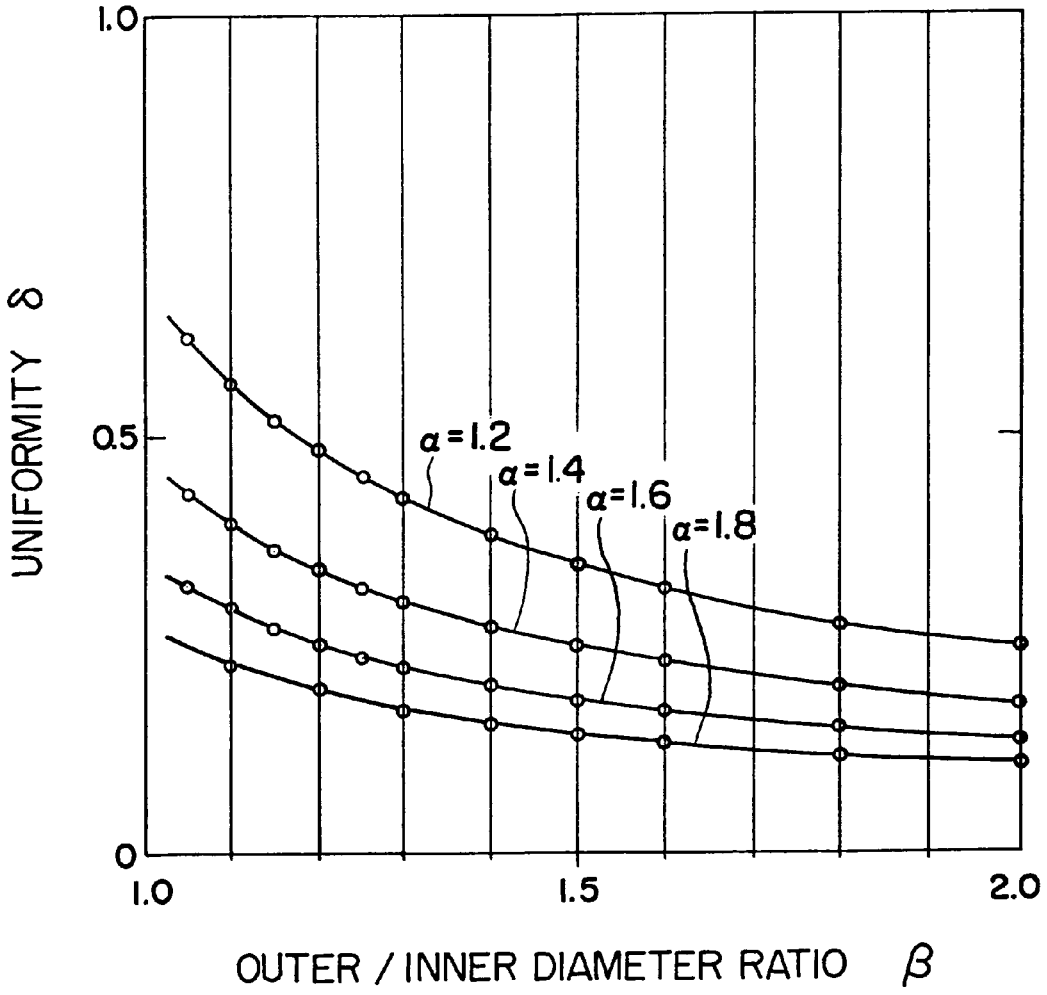
FIG. 11 graphs the results of simulations of the effect of the ratio of outer to inner diameters on the uniformity of the sliding distance distribution.

FIG. 10 shows the results of simulations in which the rotational speed ratio $\kappa$ was kept at 2, but the inner-diameter/utilization-region-width ratio $\alpha$ was varied within the range of 1.0 to 2.0 with dressers having outer/inner diameter ratios $\beta$ of 1.1, 1.2, 1.4, and 1.6. FIG. 11 shows the results of further simulations in which the outer/inner diameter ratio $\beta$ was varied within the range of 1.0 to 2.0 with dressers having inner-diameter/utilization-region-width ratios $\alpha$ of 1.2, 1.4, 1.6, and 1.8.

As can clearly be seen from FIGS. 10 and 11, the uniformity and the symmetry of the sliding distance distribution improve as the values of either of the inner-diameter/utilization-region-width ratio $\alpha$ and the outer/inner diameter ratio $\beta$ increase.

Figure 4:
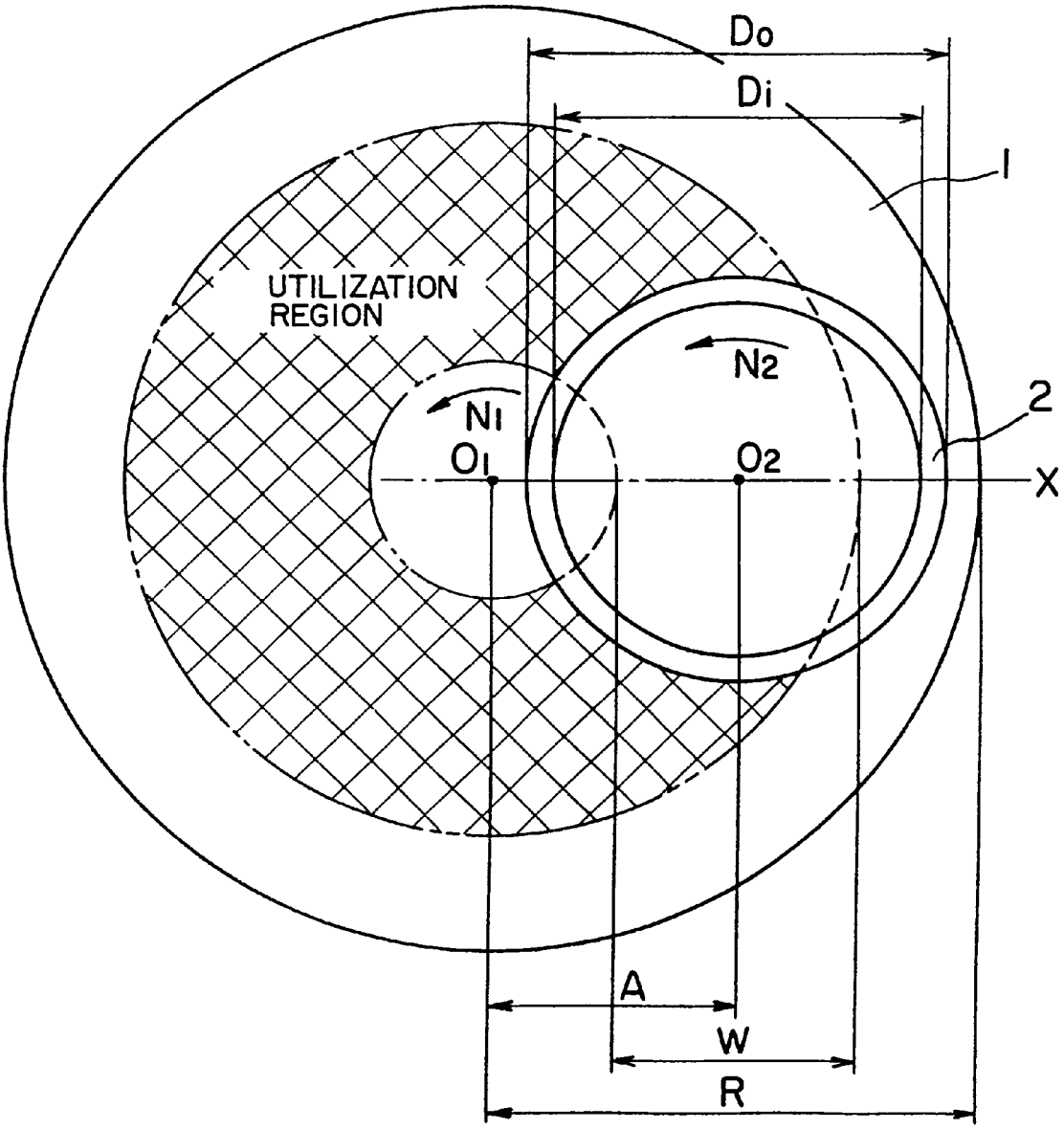
FIG. 4 is a schematic view of the relationship between the motions of the dresser and the abrasive cloth.

However, as can be seen from the definitions of the inner-diameter/utilization-region-width ratio $\alpha$ and outer/inner diameter ratio $\beta$ in Table 1 and from FIG. 4, the following relationship holds between the radius R of the abrasive cloth, the width W of the utilization region, $\alpha$, and $\beta$:

$$R \geqq Do = \alpha\beta W \tag{3}$$

Therefore, making the values of $\alpha$ and $\beta$ larger will also increase the outer diameter Do of the dresser, for the same width W of the utilization region. Furthermore, the radius R of the abrasive cloth will also increase, so that a larger abrasive cloth must be used. This will make the apparatus larger, leading to increases in the floor area and volume thereof, so that larger values of $\alpha$ and $\beta$ are not preferable as dressing conditions.

It is necessary to find conditions for $\alpha$ and $\beta$ which contribute to improvements in the uniformity and symmetry of the sliding distance distribution, while controlling the size of the dresser to a suitable level. From the viewpoint of substantially effective dressing, an abrasive cloth utilization ratio $\gamma$, which is the ratio of the width W of the utilization region to the radius R of the abrasive cloth, is relevant in practice.

Figure 12:
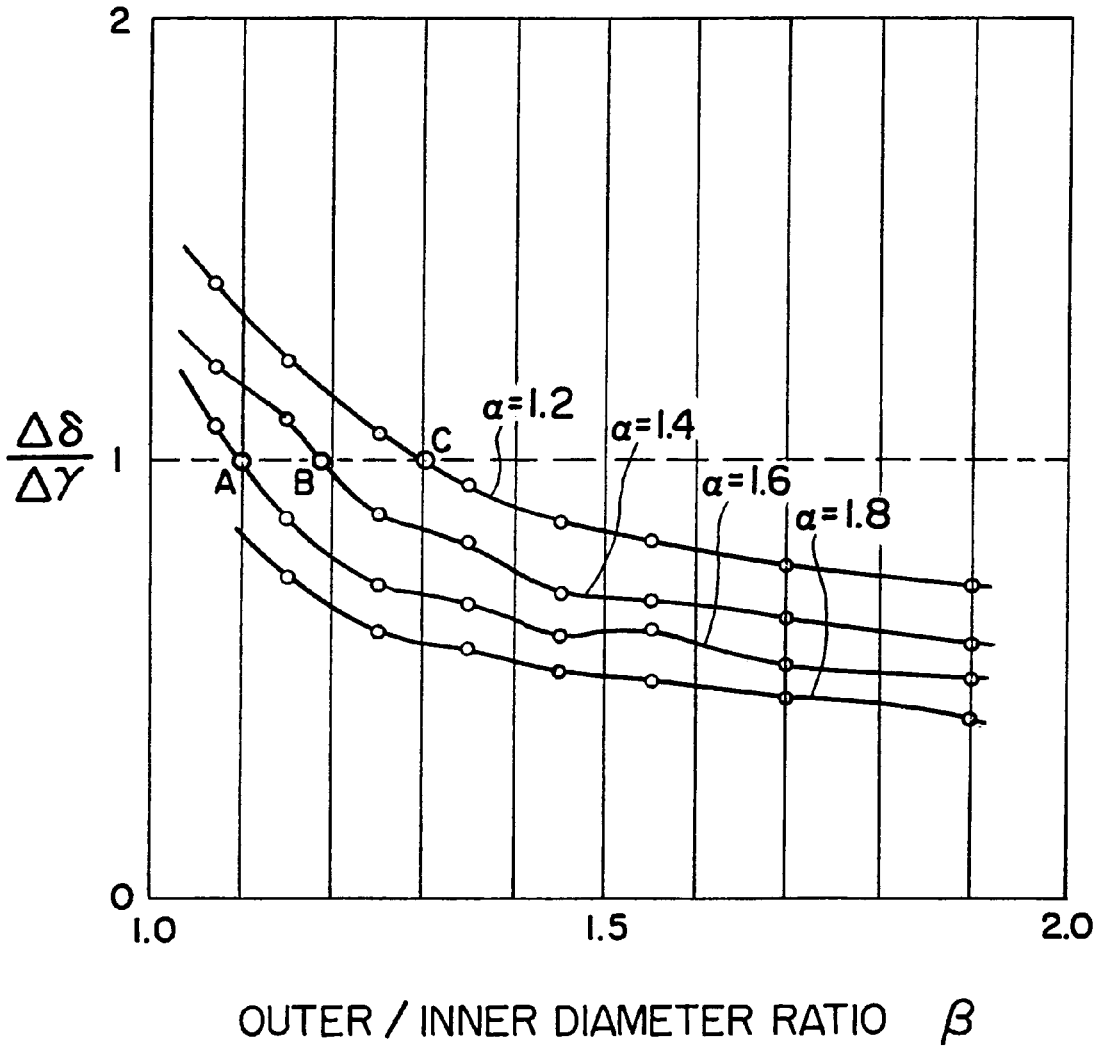
FIG. 12 graphs the results of simulations of the relationship between improvement in the uniformity of the sliding distance distribution and decrease in the utilization ratio of the abrasive cloth, when the ratio of outer to inner diameters of the dresser is varied.

Simulations were performed to determine how the abrasive cloth utilization ratio $\gamma$ and the uniformity factor $\delta$ of the sliding distance distribution varied while the outer/inner diameter ratio $\beta$ of the dresser was varied, when R=Do, that is when the radius R of the abrasive cloth was at a minimum. The results thereof are shown in FIG. 12.

This figure is a graph of the ratio of the improvement ratio $\Delta\delta$ in the uniformity factor $\delta$ of the sliding distance distribution with respect to the reduction ratio $\Delta\gamma$ of the abrasive cloth utilization ratio $\gamma$, when the outer/inner diameter ratio $\beta$ was varied for dressers with inner-diameter/utilization-region-width ratios $\alpha$ of 1.2, 1.4, 1.6, and 1.8. This graph shows that the effect of the improvement in the uniformity of the sliding distance distribution was greater than the drop in the utilization ratio of the abrasive cloth, provided that the value of $\Delta\delta/\Delta\gamma$ was 1 or greater. When the value of $\Delta\delta/\Delta\gamma$ was less than 1, the utilization ratio of the abrasive cloth dropped but the improvement in uniformity of the sliding distance distribution was small.

Consider points A, B, and C, at which each curve crosses the line $\Delta\delta/\Delta\gamma=1$. In the vicinity of these points A, B, and C, it is considered that the effect of the improvement in uniformity balances the effect of the improvement in utilization ratio. If the product of $\alpha$ and $\beta$ ($\alpha\cdot\beta$) is calculated at each of the points A, B, and C, this value is 1.76, 1.65, and 1.56, respectively. It is also qualitatively clear from FIG. 12 that, if each of the inner-diameter/utilization-region-width ratio $\alpha$ and the outer/inner diameter ratio $\beta$ is increased, $\Delta\delta/\Delta\gamma$ becomes less than 1 and the effect of the improvement in uniformity tends not to operate. If the maximum value of ($\alpha\cdot\beta$) is approximately 1.8 and it generally lies in the region of 1.5 to 1.8, the effect of the improvement in uniformity balances the effect of the improvement in utilization ratio.

When $\alpha$ and $\beta$ are set in this manner within the range of $1.5 \leqq (\alpha\cdot\beta) \leqq 1.8$, the relationship of Equation (3) ensures that the outer diameter Do of the dresser is 1.8 times or less the width W of the utilization region, and is preferably within the range of 1.5 to 1.8 times that width. Therefore, if the outer diameter Do of the dresser is within that range, it is possible to improve the uniformity of the sliding distance distribution without causing any extreme deterioration of the utilization ratio of the abrasive cloth.

To summarize the above discussion, when dressing an abrasive cloth that has a radius R which is not too large, the outer diameter Do of the dresser can be set to no more than 1.8 times the width W of the utilization region, more preferably to within the range of:

$$1.5W \leqq Do \leqq 1.8W$$

and an abrasive cloth having a corresponding radius R can be used. This makes it possible to provide the optimal dressing effect, while preventing any increase in size of the polishing machine itself.

It should be noted that, if there is some leeway in the size of the abrasive cloth or the apparatus itself, there is no need to maintain the above relationship between the outer diameter Do of the dresser and the width W of the utilization region, and thus the abrasive cloth can be dressed by using a dresser having values of inner-diameter/utilization-region-width ratio $\alpha$ and outer/inner diameter ratio $\beta$ that are as large as possible. Use of such a dresser makes it possible to increase the uniformity of the sliding distance distribution, so that the abrasive cloth can be dressed with a uniform, horizontal flatness.

It is thought that any bias in the position of the utilization region of the abrasive cloth toward the inner side or the outer side of the abrasive cloth will have an effect on the uniformity and flatness of the sliding distance distribution.

Figure 13:
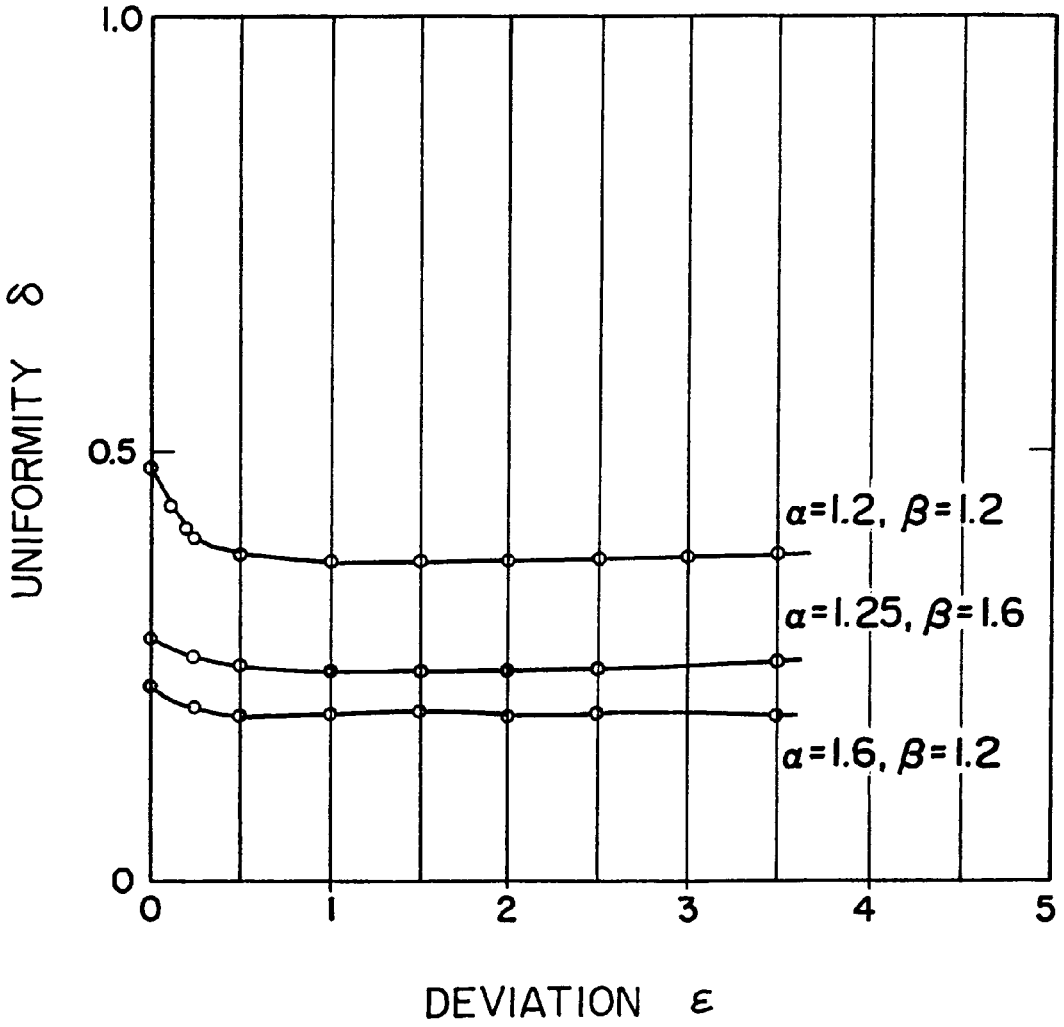
FIG. 13 graphs the results of simulations of the improvement in the uniformity of the sliding distance distribution when the deviation of the central position of the utilization region of the abrasive cloth is varied.

The results of simulations relating to the deviation $\epsilon$ of the central position of the utilization region, which is one of the dressing conditions listed in Table 1, are shown in FIG. 13.

In this case, the deviation $\epsilon$ of the central position of the utilization region is defined as:

$$\epsilon=(A-Do/2)/W \quad (4)$$

Referring to FIG. 4, this deviation $\epsilon$ is zero when O2, which is the center of rotation of the dresser 2 and also the center of the utilization region of the abrasive cloth 1, is positioned further inward in the radial direction, in other words, when A=Do/2. This deviation $\epsilon$ expresses the ratio of the amount of deviation when the utilization region has slipped further outward in the radial direction from this position, with respect to the width W of the utilization region.

The simulations summarized in FIG. 13 were performed to investigate changes in the uniformity of the sliding distance distribution caused by the deviation $\epsilon$, for three types of dresser with differing values of inner-diameter/utilization-region-width ratio $\alpha$ and outer/inner diameter ratio $\beta$.

It can be seen from this figure that the uniformity factor $\delta$ clearly decreases for increasing values of deviation $\epsilon$ up to approximately 0.2. The effect of this improvement in uniformity is initially large, but it gradually decreases within the range of deviation $\epsilon$ of 0.2 to 0.5, and, after 0.5, no improvement in the uniformity of sliding distance distribution can be found.

The most preferable range of deviation $\epsilon$ of the central position of the utilization region for improving the sliding distance distribution is therefore up to 0.2.

From Equation (4), the distance A from the center of polishing O1 to the central position of the utilization region O2 is given by:

$$A=\epsilon W+Do/2$$

And $\epsilon$ is zero when A=Do/2. It is therefore possible to make the sliding distance distribution more uniform by offsetting the utilization region of the abrasive cloth from a position on the innermost side ($\epsilon$=0) further outward by at least approximately 0.2 times the width of the utilization region, up to a maximum of 0.5 times that width.

Note that it is clear that the effect of the improvement in uniformity within the range of deviation $\epsilon$ of 0.2 to 0.5 is small, and moreover that the effects of the inner-diameter/utilization-region-width ratio $\alpha$ and outer/inner diameter ratio $\beta$ are greater.

The present invention was described above by way of example as an embodiment that dresses an abrasive cloth that is disc-shaped and has a radius that is greater than or equal to the outer diameter of the dresser. However, the dressing method of this invention can also be applied to the dressing of an abrasive cloth or a polishing pad having a form that is not disc-shaped and a reduced portion outside the utilization region, provided that the pressure used to press the dresser grindstone against the abrasive cloth is not too dramatically uneven. Similar effects can be obtained in such a case.

The description now turns to a method and apparatus for dressing an abrasive cloth in accordance with this invention that use a dresser having an outer diameter that is less than the width of the utilization region of the abrasive cloth, with reference to the accompanying drawings.

Figure 14:
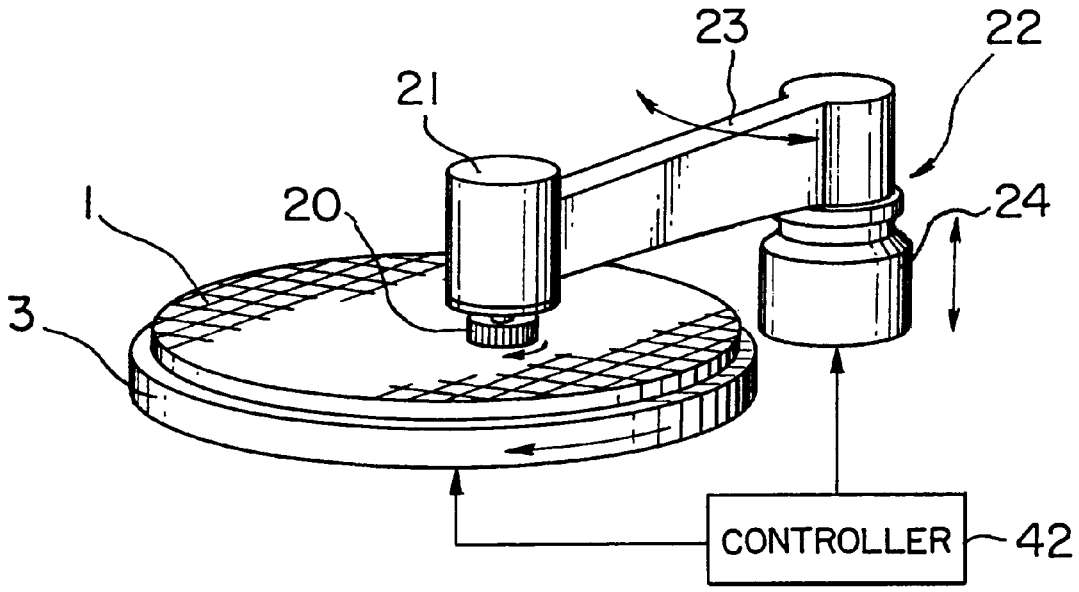
FIG. 14 is a perspective view of an embodiment of the abrasive cloth dressing apparatus of this invention.

An apparatus for implementing this method of dressing an abrasive cloth in accordance with this invention is shown in FIG. 14. In this figure, reference number 1 denotes the abrasive cloth and reference number 20 denotes a dresser.

A turn table 3 is linked to a rotational drive mechanism (not shown in the figure) that is incorporated within a base.

A disc-shaped or narrow annular grindstone is used as the dresser 20 for dressing the abrasive cloth 1 when the polishing capability thereof has deteriorated. This dresser 20 is held by a rotational dresser head 21 that configures a rotational dresser means. Note that the rotational speeds of the turn table 3 and the dresser grindstone 20 are such that they can be set and controlled as required by a controller 42. This controller 42 is also capable of controlling the oscillating speed of a oscillation mechanism 22, and also of controlling the amplitude and linear speed of the reciprocal motion of the dresser 20, in a manner that will be described later.

Figure 16:
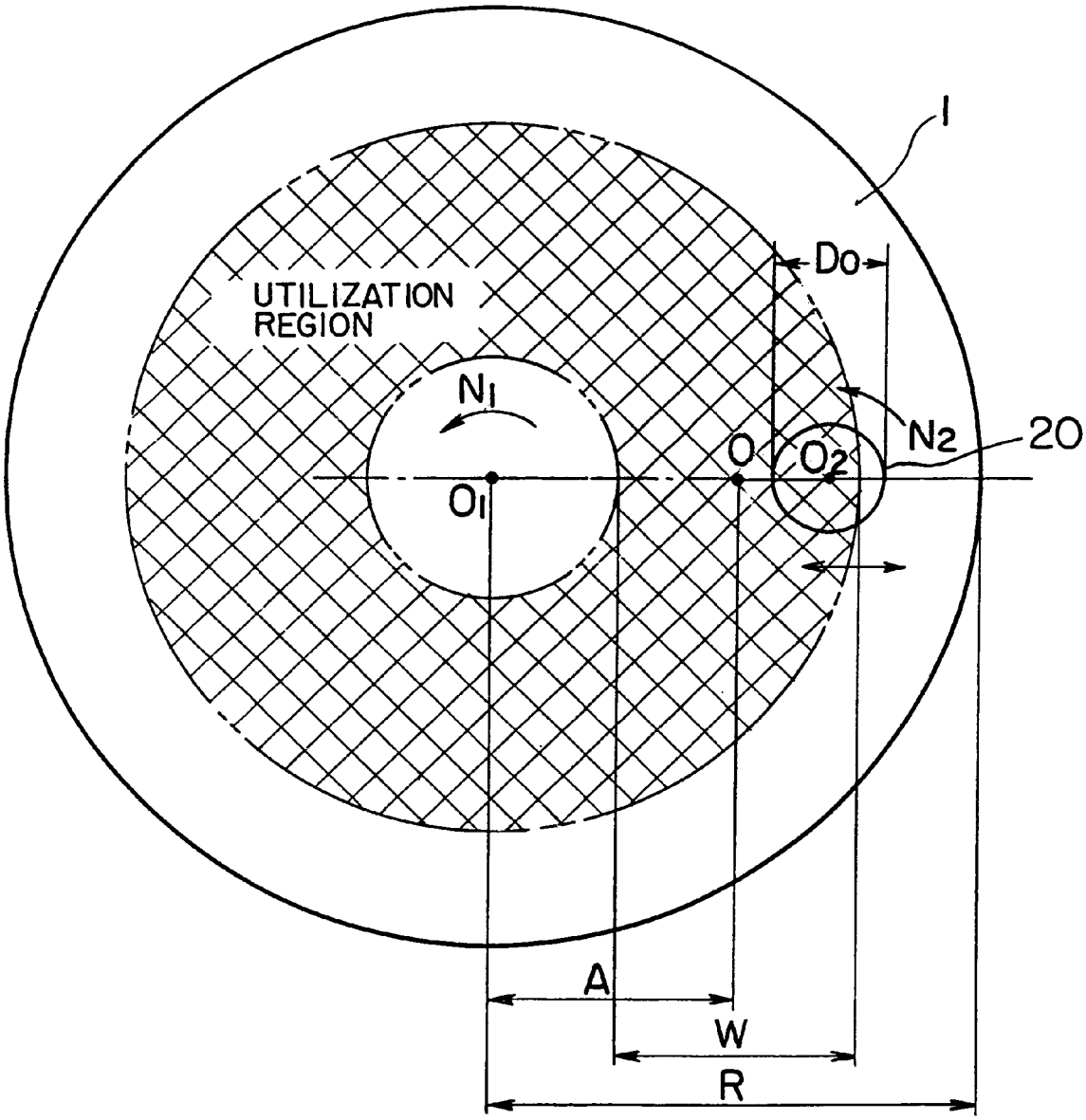
FIG. 16 is a schematic illustrative view of the relative positional relationship between a dresser and an abrasive cloth placed on a rotational surface plate, used in the method of dressing an abrasive cloth in accordance with this invention.

The rotational dresser head 21 is attached to one end of a swing arm 23. The other end of this swing arm 23 is linked to a dresser elevator mechanism 24 by a motor for oscillating (not shown in the figure). The oscillation mechanism 22 is configured of the swing arm 23 and the motor for oscillating. When the abrasive cloth 1 is to be dressed, the elevator mechanism 24 presses the dresser 20 against the abrasive cloth 1 with a suitable pressure. During this time, a rotational motion is imparted to the dresser 20 by the rotational dresser head 21. The dresser 20 is subjected to a reciprocal motion cutting along the radial direction of a range comprising the utilization region of the abrasive cloth 1 as shown in FIG. 16, so that the surface of the abrasive cloth 1 can be dressed.

During the dressing, rotational speeds N1 and N2 are always applied to the abrasive cloth 1 and the dresser 20 in the same direction. While the dresser 20 is not being used, the oscillation mechanism 22 causes the swing arm 23 to be swiveled in a direction away from the rotational surface plate 3, so that the dresser 20 retreats from the abrasive cloth 1.

Figure 15:
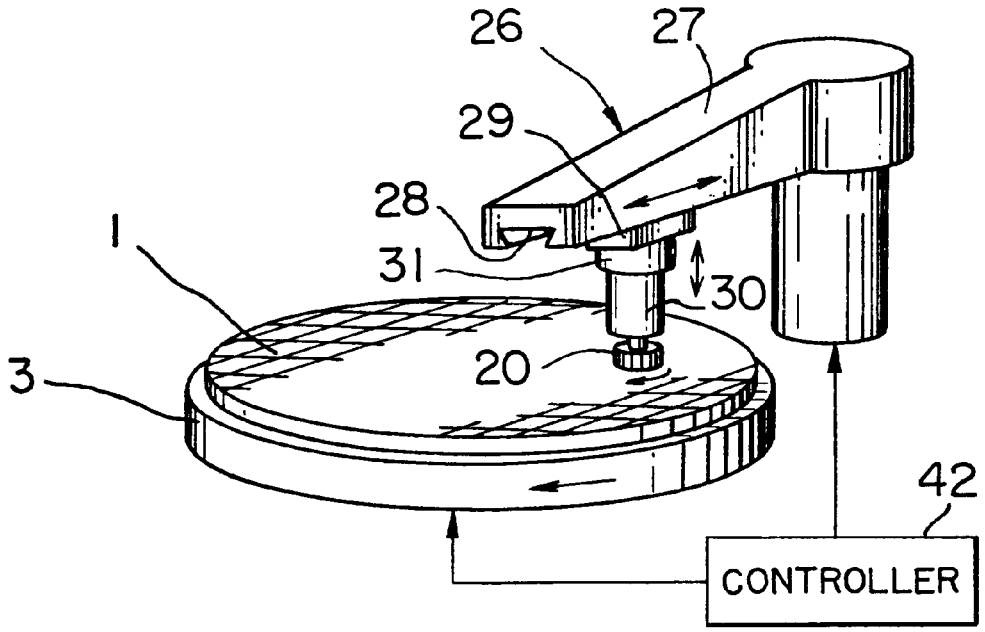
FIG. 15 is a perspective view of another embodiment of the abrasive cloth dressing apparatus of this invention.

Another embodiment of the dressing apparatus shown in FIG. 15 uses a linear movement mechanism to cause the dresser 20 to move in the radial directions of the abrasive cloth 1.

This dressing apparatus is provided with a linear reciprocal motion mechanism 26 instead of the oscillation mechanism 22 of FIG. 14. A guide groove 28 is provided in a lower surface of a horizontal beam 27 of the linear reciprocal motion mechanism 26, running in the lengthwise direction thereof. A reciprocal base 29 is engaged in this guide groove 28 in a freely sliding manner, and it holds a rotational dresser head 30 with a dresser elevator mechanism 31 therebetween. This reciprocal base 29 is driven by a linear drive mechanism that is incorporated into the horizontal beam 27. The dresser 20 is capable of reciprocating linearly in the radial direction over the surface of the abrasive cloth 1, within a range that includes the utilization region of the abrasive cloth 1.

In the dressing apparatus of FIG. 15 as well, the horizontal beam 27 is capable of swivelling. During the dressing, the horizontal beam 27 is positioned so that it is aligned with the radial direction of the abrasive cloth 1. As a result, the direction in which the dresser 20 reciprocates is made to be the same as the radial direction of the abrasive cloth 1.

There now follows a more detailed description of the present invention, using the results of simulations of the dressing of abrasive cloths by the above described apparatus, while the various processing conditions were varied.

Figure 3A:
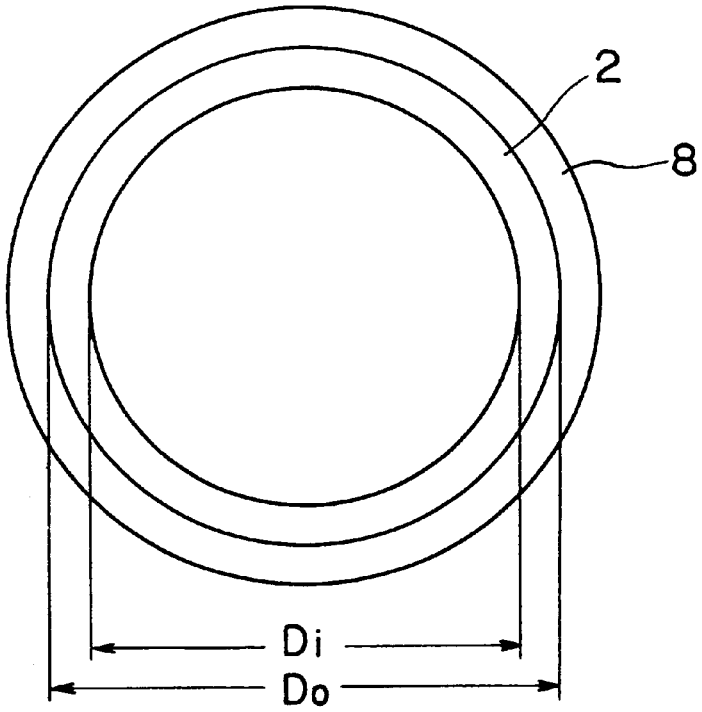
FIGS. 3(*a*) and 3(*b*) are plan views of the dressers of FIG. 2.
Figure 3B:
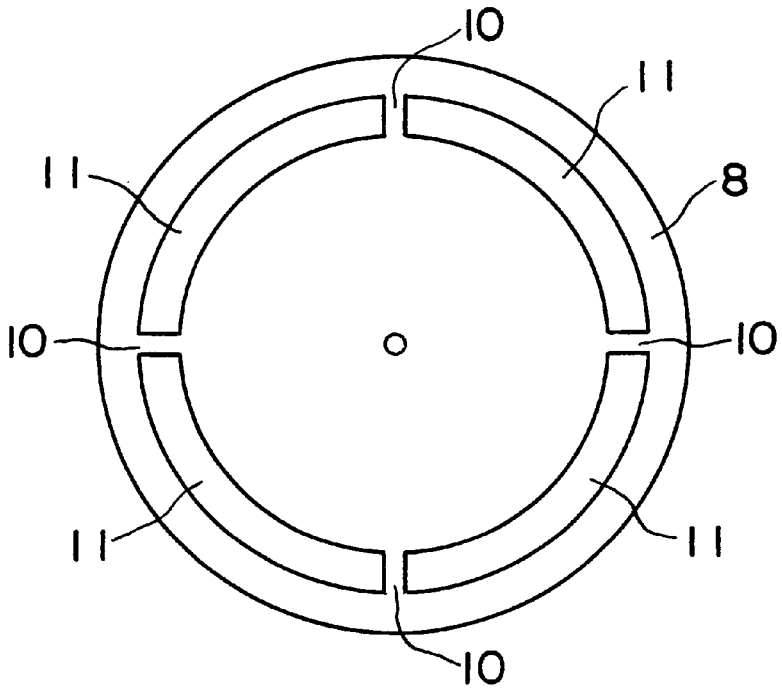
Figure 17:
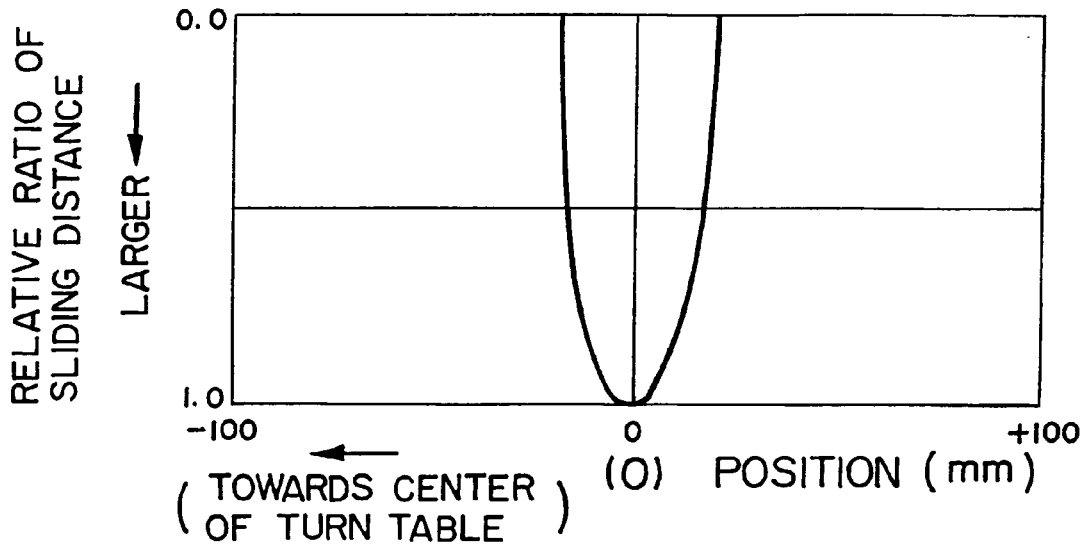
FIG. 17 graphs the results of simulations of the sliding distance distribution of the dresser, when an abrasive cloth was dressed without imparting a reciprocal motion to a disc-shaped dresser in the radial direction of the abrasive cloth.
Figure 18:
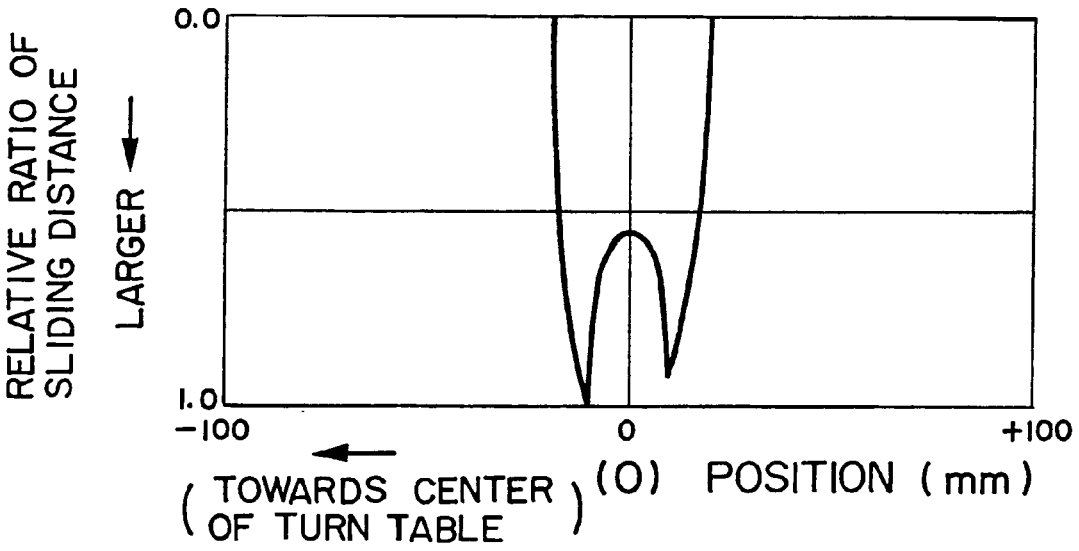
FIG. 18 graphs the results of simulations of the sliding distance distribution of the dresser, when an abrasive cloth was dressed without imparting a reciprocal motion to a narrow annular dresser in the radial direction of the abrasive cloth.

The results of computer simulations of the sliding distance distribution of the dresser 20 are shown in FIGS. 17 and 18. In this case, the abrasive cloth 1 was dressed while the center O2 of the dresser 20 (see FIG. 16) was aligned with the center O of the utilization region of the abrasive cloth 1 and no reciprocal motion was imparted in the radial direction. Of these figures, FIG. 17 shows the results obtained by using a disc-shaped dresser as the dresser 20 and FIG. 18 shows the results obtained by using a narrow annular dresser. In both cases, the outer diameter Do of the dresser (see FIG. 3) was 40 mm.

In these figures, the ratio of the sliding distance at each location in the radial direction to the maximum sliding distance is plotted along the vertical axis. The curves in these figures represent the characteristics of the form of the abrasive cloth after it has been dressed.

It is clear from FIG. 17 that, if a disc-shaped dresser is used in which the outer diameter Do is less than the width W of the utilization region of the abrasive cloth 1, and if no reciprocal motion is imparted thereto in the radial direction of the abrasive cloth 1, there will be deep abrasion at a location slightly towards the center of the abrasive cloth 1 from the center O of the width W of the utilization region.

If a narrow annular dresser is used, it is clear from FIG. 18 that the amount of dressing within a range on both sides of the center O of the width W of the utilization region decreases towards the center O.

Numerical models are made of the form of the sliding distance distribution obtained in FIGS. 17 and 18. These are shown in FIG. 19.

Figure 19:
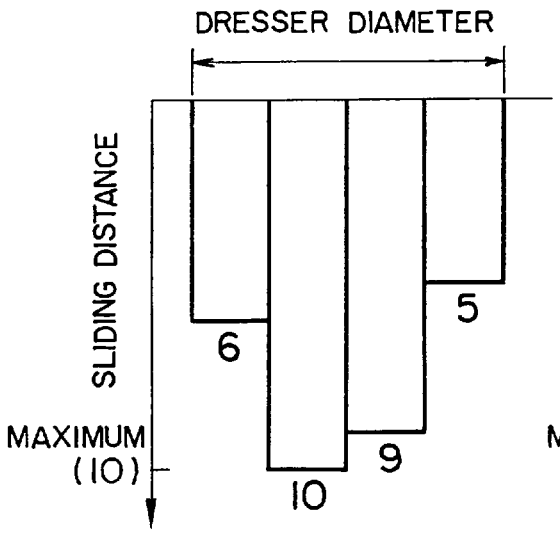
FIGS. 19(*a*) and 19(*b*) show numeric models of sliding distance for a disc-shaped dresser and an annular dresser.
Figure 19:
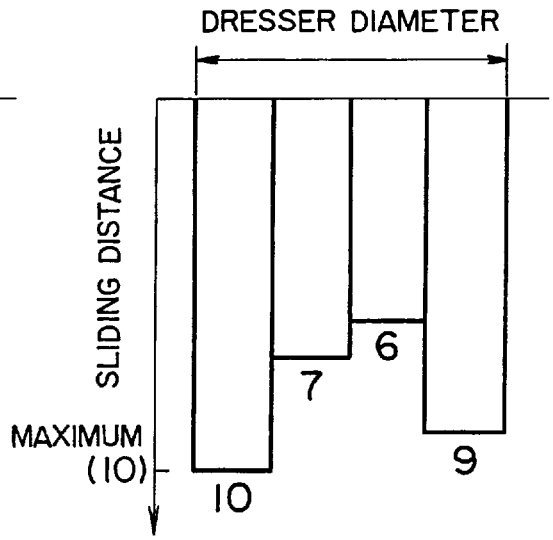

Of these figures, FIG. 19(*a*) shows a model of sliding distance distribution form obtained when a disc-shaped dresser is used, simplified as four rectangles, and FIG. 19(*b*) shows a similar simplified model for a narrow annular dresser.

The amount that the dresser 20 moves in the radial direction of the abrasive cloth 1 during one rotation of the abrasive cloth 1 is equivalent to the width of each rectangular region and 4 times that width gives the outer diameter of the dresser 20. The length of each rectangular region expresses a ratio with respect to a maximum sliding distance of 10. FIGS. 19(*a*) and 19(*b*) show numeric models of sliding distance distributions that approximate to the sliding distance distributions of FIGS. 17 and 18.

A numerical evaluation is performed using these numeric models of sliding distance distribution. FIG. 20 shows the evaluation of the sliding distance while the dresser 20 makes one reciprocal motion over a range equivalent to 5 times the outer diameter of the dresser and return to its original position.

FIG. 20(*a*) shows the results obtained for the disc-shaped dresser of FIG. 19(*a*) and FIG. 20(*b*) shows those obtained for the narrow annular dresser of FIG. 19(*b*).

Taking FIG. 20(*a*) as an example, the sliding distances at an initial position were 6, 10, 9, and 5. Between that position and a position displaced by one rectangular portion, these sliding distances increased to (10+6), (9+10), (8+9) and 5. If the sliding distance is assumed to be proportional to the resultant removal, the removal produced overall as the dresser moves through one reciprocal motion in the radial direction is the sum of the numerical values shown vertically for each position. These total sums are shown along the bottom edge of each graph. These numerical values correspond to the distribution of sliding distances at each location on the abrasive cloth, for abrasive cloths that are finally dressed by a disc-shaped dresser and an annular dresser.

As a result, there is a portion within the range of reciprocal motion which is three times the outer diameter of the dresser, and which includes the center of the reciprocal motion, wherein the total values of sliding distance are the same. In other words, this portion receives uniform dressing. In contrast, it is clear that there are non-uniform portions where there are variations, in the region equivalent to the outer diameter of the dresser to the left and right sides of this uniform region.

Figure 21A:
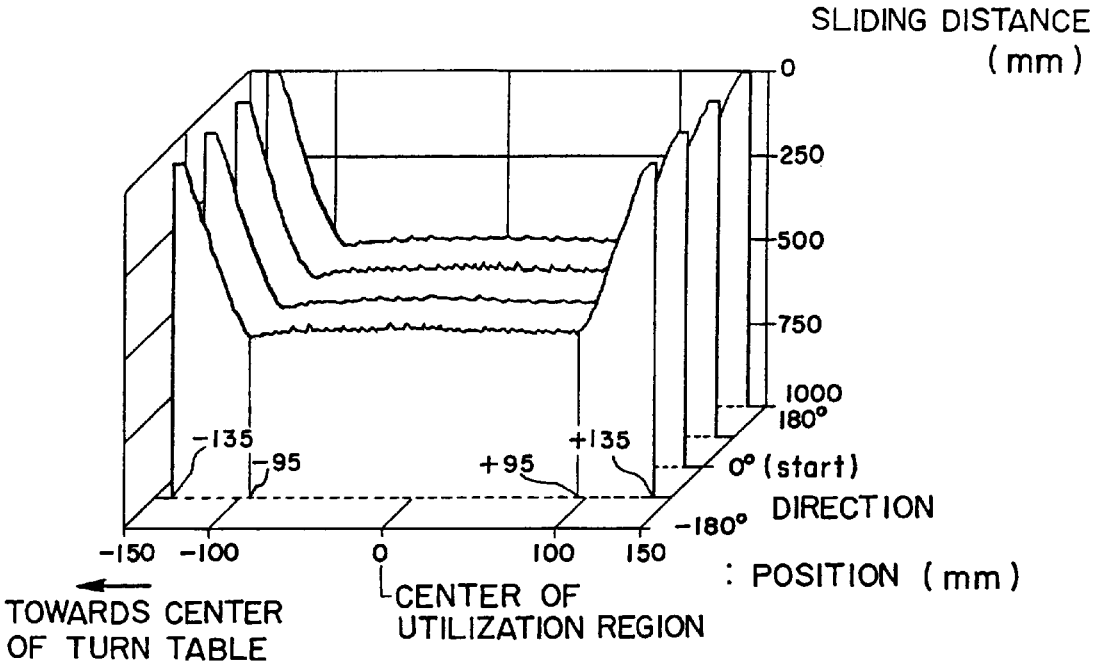
FIGS. 21(*a*) and 21(*b*) graph the results of simulations of the sliding distance distribution for a disc-shaped dresser and a narrow annular dresser.
Figure 21B:
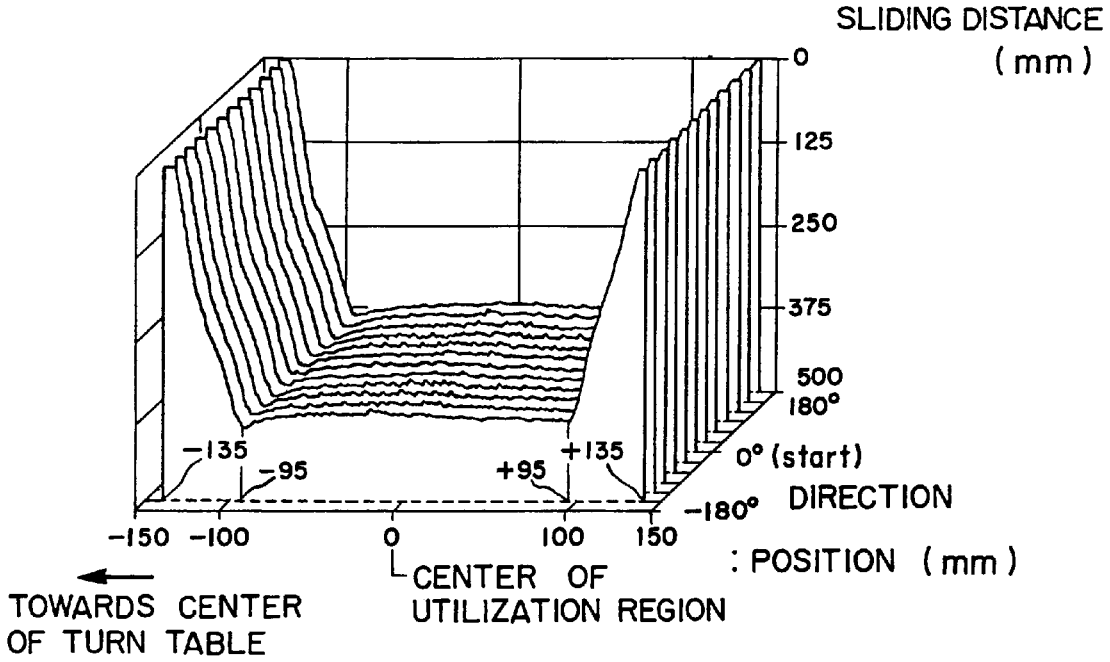

The results of simulations of the sliding distance distribution obtained when dressing was performed with a reciprocal motion amplitude of 270 mm are shown in FIGS. 21(*a*) and 21(*b*), wherein the dresser 20 is a disc-shaped dresser with an outer diameter of 40 mm and a narrow annular dresser of the same diameter, respectively. In this case, the simulations covered four cross-sections through the center of rotation of the abrasive cloth for the disc-shaped dresser and cross-sections taken at 30° intervals around the center of rotation of the abrasive cloth for the annular dresser, each during one cycle until the dresser 20 returns to the same positional relationship as that at the start of the dressing.

According to the results of these simulations, it is clear that a substantially uniform portion is produced at the center. In contrast, portions of non-uniform sliding distance are produced at either end of the reciprocal motion within ranges equivalent to the outer diameter of the dresser (−135 to −95 mm and +95 to +135 mm). This conforms with the results of the modeling shown in FIG. 20.

Non-uniform areas equivalent to the outer diameter of the dresser are produced at the inner and outer sides of the amplitude of reciprocal motion. To maintain the sliding distribution within the utilization region of the abrasive cloth to be uniform, it is necessary to ensure an amplitude of reciprocal motion of the dresser that is sufficiently in excess of the outer diameter of the dresser inside and outside the radial direction of the abrasive cloth 1, in comparison with the width W of the utilization region. Note, however, that the amplitude of this reciprocal motion is controlled by upper limit of the radius of the abrasive cloth 1.

The above discussion concerned analytical results obtained for the relationship between the utilization region of the abrasive cloth 1 and the amplitude of the reciprocal motion of the dresser 20. The description now turns to the results obtained from analysis of simulations of the relationship between the amount of movement in the radial direction of the dresser 20 for one rotation of the abrasive cloth 1 (hereinafter called the dresser movement amount) and the uniformity of the sliding distance distribution. These results are shown in FIG. 22.

In this case, the uniformity plotted along the vertical axis of each graph in FIG. 22 refers to the uniformity factor δ used in the first embodiment. This uniformity factor δ expresses the ratio of the difference between the maximum value L and minimum value S of the sliding distance, shown in FIG. 7:

$$\delta=(L-S)/L$$

On the assumption that there is a proportional relationship between the sliding distance and the removal, the sliding distance distribution is uniform as the value of this uniformity factor decreases, and the surface of the abrasive cloth 1 is dressed in a flat manner.

In each graph of FIG. 22, movement pitch is plotted along the horizontal axis as a non-dimensional number obtained by dividing the amount of movement of the dresser by the outer diameter of the dresser. This means that the dresser movement amount is a relative value determined by the relationship with the outer diameter of the dresser.

The value of uniformity factor δ obtained by simulations for a disc-shaped dresser is shown in FIG. 22(*a*). In contrast, the results of simulations of narrow annular dresser are shown in FIGS. 22(*b*), 22(*c*), and 22(*d*). With these annular dressers, it is necessary to consider the size of the width of the grindstone with respect to the outer diameter thereof. Therefore, these simulations concerned the relationship with uniformity factor δ for narrow annular dresser having ratios of width to outer diameter of ¼, ⅛, and 3/40, respectively.

Taking a disc-shaped dresser and an annular dresser having a relatively large grindstone width first of all, it is clear from FIGS. 22(*a*) and 22(*b*) that there is a dramatic improvement in the uniformity of the sliding distance distribution when the movement pitch of the dresser movement amount is ¼ or less, in other words when the amount of movement is ¼ or less with respect to the outer radius of the dresser. Furthermore, for a disc-shaped dresser and an annular dresser having a relatively large grindstone width, it is clear that the uniformity can be made to be substantially 0.1 or less, that is the variations in sliding distance distribution can be limited to within 10%, by making the movement pitch of the dresser movement amount to be ⅛ or less, in other words an amount of movement that is ⅛ or less of the outer radius of the dresser.

The effects of simulations shown in FIGS. 22(*c*) and 22(*d*) concern narrow annular dressers in which the grindstone width is comparatively small, in other words, where the grindstone width is less than ¼ of the outer diameter of the dresser. With these dressers, the grindstone width is smaller than ¼ of the outer diameter of the dresser, setting limits on the suitable range of the dresser movement amount. It is therefore highly likely that the suitable range of dresser movement amount is related to the dimensions of the grindstone width. In practice, as shown in FIG. 22(*c*), no particular improvement in the uniformity is seen when the grindstone width is small at ⅛, even when the movement amount is ¼ of the outer diameter of the dresser. It is, however, clear that the uniformity of the sliding distance distribution can be set to no more than 0.1, in other words, the variations in the sliding distance distribution can be limited to within 10%, if the movement amount is set to the same value of ⅛ of the outer diameter of the dresser as the grindstone width. Similarly, FIG. 22(*d*) shows that the improvement in the uniformity of the sliding distance distribution is dramatic when the grindstone width is 3/40 of the outer diameter of the dresser, so that the dresser movement amount can be set to be the same 3/40 of the outer diameter of the dresser as the grindstone width.

To summarize the above discussions, an improvement in the uniformity of the sliding distance distribution is seen for a disc-shaped dresser when the movement amount of the dresser is ¼ or less of the outer diameter of the dresser, and a particularly effective result is achieved when the movement amount of the dresser is ⅛ or less of the outer diameter of the dresser. For a narrow annular dresser, an effect on the uniformity of the sliding distance distribution is seen if the dresser movement amount is set to be ¼ of the outer diameter of the dresser or the grindstone width, whichever is the smaller, and it is particularly effective to set the dresser movement amount to be ⅛ of the outer diameter of the dresser or the grindstone width, whichever is the smaller.

It should be noted that, since the movement amount of the dresser and the desired dressing time taken during actual dressing are in an inverse relationship, setting the movement amount of the dresser to be extremely small will cause a deterioration in the dressing efficiency. It is therefore preferable to set a lower limit to the dresser movement amount that is approximately 1/16 of the outer diameter for a disc-shaped dresser or 1/16 of the outer diameter or ½ of the grindstone width, whichever is the smaller, for an annular dresser.

The above described results of simulations concerning the amplitude of reciprocal motion and the movement amount of the dresser can be applied to an apparatus such as that of FIG. 14 which imparts an arc-shaped reciprocal motion to the dresser 20 by the oscillation of the swing arm 23, across the utilization region in the radial direction. Similarly, they can be applied to an apparatus such as that of FIG. 15 which imparts a linear reciprocal motion to the dresser 20. However, the arc-shaped reciprocal motion differs from the linear reciprocal motion in that a component of the movement speed of the dresser grindstone 20 in the radial direction of the abrasive cloth varies with position.

Figure 23:
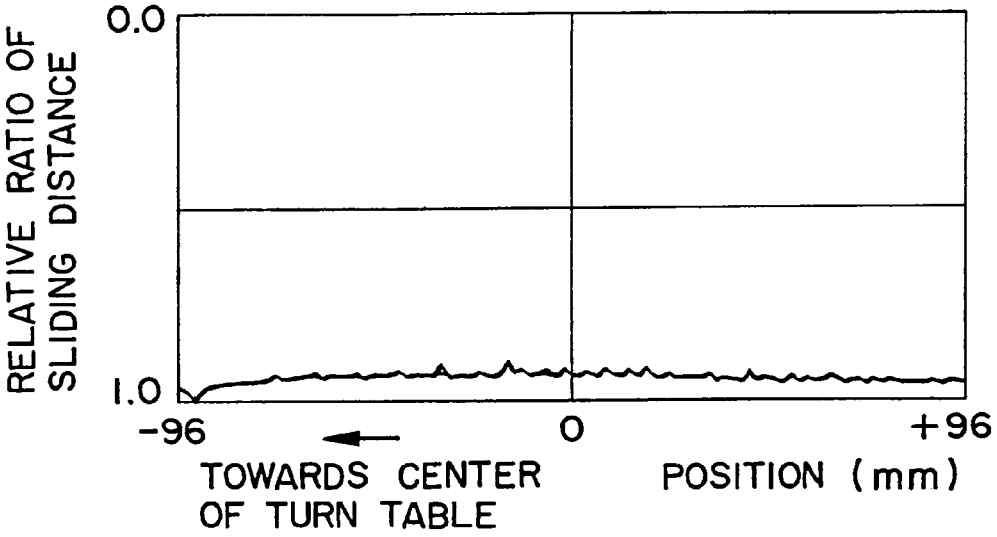
FIGS. 23(*a*) and 23(*b*) show the results obtained from simulations of varying the length of a swing arm, to investigate the effects on the component of the movement speed of the dresser in the radial direction of the abrasive cloth.
Figure 23:
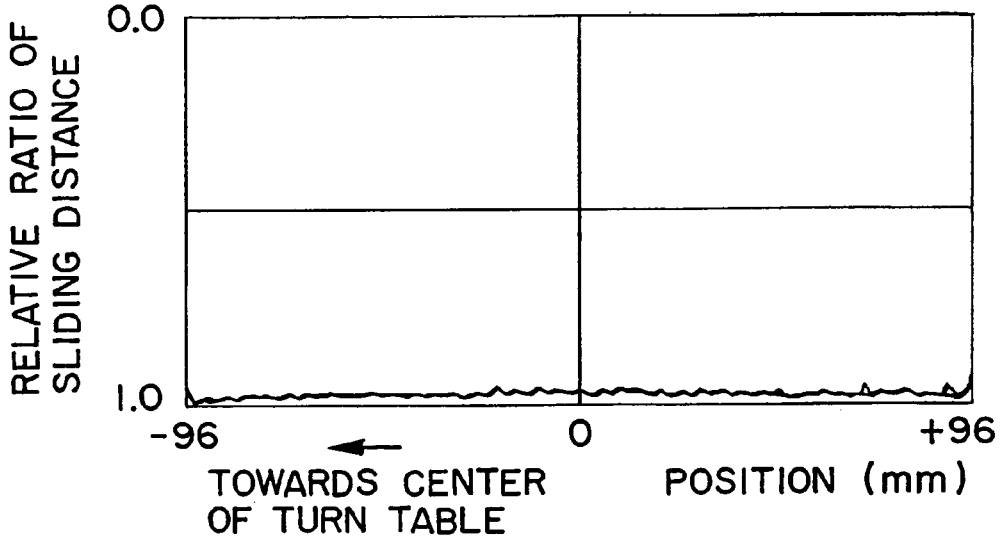

The results of simulations of the sliding distance distribution obtained by varying the length of the swing arm 23 are shown in FIG. 23, to investigate the effects on the component of the movement speed of the dresser 20 in the radial direction of the abrasive cloth 1. In these graphs, location in the widthwise direction of the utilization region of the abrasive cloth is plotted along the horizontal axis and the ratio of sliding distances at each location is plotted along the vertical axis, with the maximum sliding distance being 1. FIG. 23(*a*) shows the results obtained when the swing arm 23 is short and FIG. 23(*b*) shows the results obtained when the swing arm 23 is long.

It is clear from a comparison of FIGS. 23(*a*) and 23(*b*) that a longer swing arm 23 reduces variations in the component of the movement speed of the dresser 20 in the radial direction of the abrasive cloth 1, so that it suppresses unevenness in the sliding distance distribution. It is therefore preferable make the length of the swing arm 23 of the oscillation mechanism 22 as long as possible, in order to improve the uniformity of the sliding distance distribution.

Although this shows it is better to have a longer swing arm 23, a longer arm could be a disadvantage in that it will increase the size of the dressing apparatus.

When a oscillation mechanism 22 is used to impart a reciprocal motion to the dresser 20 in such a case, it is preferable that a controller 42 is provided with a function that controls the frequency in such a manner that the component of the dresser movement speed in the radial direction of the abrasive cloth 1 is kept constant. This makes it possible to dress the abrasive cloth 1 in such a manner that the sliding distance distribution is uniform, without increasing the total length of the oscillation mechanism 22.

In contrast thereto, if a linear reciprocal motion is imparted to the dresser 20, there is no problem is the direction of movement is aligned with the radial direction of the abrasive cloth, because this keeps constant the component of the dresser movement speed in the radial direction of the abrasive cloth 1. However, if the direction of movement of the dresser 20 is not aligned with the radial direction of the abrasive cloth 1, an improvement in the uniformity of the sliding distance distribution can also be achieved by controlling the movement speed in such a manner that the component of the dresser movement speed in the radial direction of the abrasive cloth 1 is kept constant, in a similar manner to that of the oscillation mechanism 22.

What is claimed is:

1. A method of dressing an abrasive cloth used in a polishing process, comprising the steps of:

fixing an abrasive cloth having a wide annular utilization region to a turn table;

pressing a narrow annular dresser having an inner diameter of at least a width of said utilization region of said abrasive cloth against said abrasive cloth; and rotating said abrasive cloth and said dresser in the same direction and at a predetermined ratio (N1/N2) of rotational speeds, while pressing said dresser against said abrasive cloth, the predetermined ratio (N1/N2) of the rotational speed (N1) of said abrasive cloth and the rotational speed (N2) of said dresser being within a range of 1.5 to 4.0 so as to obtain a uniform distribution of distances through which said dresser slides over a surface of said abrasive cloth at each location in the radial direction within said utilization region of said abrasive cloth.

2. The method as defined in claim 1, wherein said sliding distribution of distances of said dresser is made to be uniform by setting a ratio (Di/W) of the inner diameter (Di) of said dresser to the width (W) of said utilization region of said abrasive cloth, wherein Di is a value greater than W, or a ratio (Do/Di) of an outer diameter (Do) to the inner diameter (Di) of said dresser, wherein Do is a value greater than Di.

3. The method as defined in claim 2, wherein a dresser is used that has an outer diameter (Do) within a range of 1.5 to 1.8 times said utilization region width direction of said abrasive cloth and less than or equal to the radius (R) of said abrasive cloth.

4. The method as defined in any of claims 1, 2 or 3, wherein a distance (A) from a center of said abrasive cloth to a central position of said utilization region of said abrasive cloth is set to be within a range from a value that is 0.5 times the outer diameter (Do) of said dresser to a value that is 0.5 times the outer diameter of said dresser plus 0.5 times the width (W) of said utilization region, such that a relationship between the outer diameter and the width is defined by $Do/2 \leqq A \leqq Do/2+W/2$.

5. The method as defined in any of claims 1, 2 or 3, wherein a distance (A) from the center of said abrasive cloth to a central position of said utilization region of said abrasive cloth is set to be within a range from a value that is 0.5 times the outer diameter (Do) of said dresser to a value that is 0.5 times the outer diameter of said dresser plus 0.5 times the width (W) of said utilization region, such that a relationship between the outer diameter and the width is defined by $Do/2 \leqq A \leqq Do/2+W/2$, wherein said abrasive cloth consists of an elastomer, an soft plastic, a woven material with fibers arranged in a regulated manner, or a nonwoven fabrics.

6. A method of dressing an abrasive cloth used in a polishing process, comprising the steps of:

fixing an abrasive cloth having a wide annular utilization region to a turn table;

pressing a circular dresser having an outer diameter that is less than a width of said utilization region of said abrasive cloth;

rotating said abrasive cloth while imparting a reciprocal motion to said dresser in a radial direction of said abrasive cloth within said utilization region; and dressing said abrasive cloth by said dresser in such a manner that the amplitude of a reciprocal motion of said dresser is set to a range that is greater than or equal to a value (W+2Do) that is the sum of a width (W) of said utilization region of said abrasive cloth and an outer diameter (Do) of said dresser on each of an inner and outer side in the radial direction of said abrasive cloth and less than or equal to a radius (R) of said abrasive cloth so as to obtain a uniform distribution of sliding distances through which said dresser slides over a surface of said abrasive cloth at each location in the radial direction within said utilization region of said abrasive cloth.

7. The method as defined in claim 6, wherein said dresser consists of a disc-shaped dresser or a narrow annular dresser.

8. The method as defined in claim 7, wherein said dresser consists of a disc-shaped dresser, and a reciprocal motion is imparted to said disc-shaped dresser in such a manner that the amount of movement of said disc-shaped dresser in the radial direction of said abrasive cloth during one rotation of said abrasive cloth is ¼ or less of the outer diameter of said dresser.

9. The method as defined in claim 7, wherein said dresser consists of a narrow annular dresser, and a reciprocal motion is imparted to said narrow annular dresser in such a manner that the amount of movement of said annular dresser in the radial direction of said abrasive cloth during one rotation of said abrasive cloth is either ¼ of the outer diameter of said dresser or the width of said dresser, whichever is the smaller.

10. The method as defined in claim 6, wherein a reciprocal motion is imparted to said dresser in such a manner that there is a constant component of speeds of said dresser in the radial direction of said abrasive cloth during said reciprocal motion.

11. The method as defined in any one of claims 1, 2, 3, 6, 7, 8, 9 and 10, wherein said abrasive cloth consists of an elastomer, a soft plastic, a woven material with fibers arranged in a regulated manner, or a nonwoven fabrics.

* * * * *